US006442362B2

(12) United States Patent
Hirabayashi et al.

(10) Patent No.: US 6,442,362 B2
(45) Date of Patent: Aug. 27, 2002

(54) IMAGE FORMING APPARATUS FOR MAKING RECOVERY AND RESTORATION OF TONERS BY ELECTRICAL CONDUCTIVE MEMBER

(75) Inventors: Jun Hirabayashi; Harumi Ishiyama, both of Numazu; Yasunori Chigono, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,934

(22) Filed: Dec. 29, 2000

(30) Foreign Application Priority Data

Jan. 6, 2000 (JP) ..... 2000-000849

(51) Int. Cl.[7] ..... G03G 15/00; G03G 15/02

(52) U.S. Cl. ..... 399/149; 399/129; 399/174; 399/343

(58) Field of Search ..... 399/149, 150, 399/129, 174, 175, 176, 100, 343

(56) References Cited

U.S. PATENT DOCUMENTS 5,596,394 A * 1/1997 Nishiguchi et al. ..... 399/175
5,666,192 A 9/1997 Mashimo et al. ..... 399/174
6,061,539 A 5/2000 Ishiyama et al. ..... 399/175
6,118,965 A * 9/2000 Hirabayashi et al. ..... 399/175
6,125,246 A * 9/2000 Hashimoto ..... 399/174 X
6,157,800 A 12/2000 Ishiyama et al. ..... 399/175
6,173,144 B1 1/2001 Hrabayashi et al. ..... 399/222
6,226,480 B1 * 5/2001 Hirabayashi et al. ... 399/149 X

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member for bearing an electrostatic image. A developing device develops the electrostatic image on the image bearing member by toners charged with a predetermined polarity. A transfer device transfers a toner image on the image bearing member to a transferring material. An electrifying device inject-charges the image bearing member having transfer residual toners. An electrical conductive member provided and spaced apart from the image bearing member in a moving direction of the image bearing member downstream farther than the transfer means and upstream farther than the electrifying device. An electrical field forming device for forming an alternative electrical field between the electrical conductive member and the image bearing member.

21 Claims, 11 Drawing Sheets a : PEAK TO PEAK VOLTAGE OF AC VOLTAGE APPLIED TO ELECTRICAL CONDUCTIVE MEMBER 6 [V]
b : DC BIAS ELECTRIC POTENTIAL APPLIED TO ELECTRICAL CONDUCTIVE MEMBER 6 [-V]
c : DISTANCE BETWEEN ELECTRICAL CONDUCTIVE MEMBER 6 AND PHOTOSENSITIVE MEMBER 1 [μm]
d : ELECTROSTATIC CHARGE POTENTIAL OF PHOTOSENSITIVE MEMBER [-V]

STAY PHENOMENON OCCURRENCE PORTION OF ELECTROSTATIC CHARGE ACCELERATING PARTICLE m a : PEAK TO PEAK VOLTAGE OF AC VOLTAGE APPLIED TO ELECTRICAL CONDUCTIVE MEMBER 6 [V]
b : DC BIAS ELECTRIC POTENTIAL APPLIED TO ELECTRICAL CONDUCTIVE MEMBER 6 [-V]
c : DISTANCE BETWEEN ELECTRICAL CONDUCTIVE MEMBER 6 AND PHOTOSENSITIVE MEMBER 1 [μm]
d : ELECTROSTATIC CHARGE POTENTIAL OF PHOTOSENSITIVE MEMBER [-V]

a : PEAK TO PEAK VOLTAGE OF AC VOLTAGE APPLIED TO ELECTRICAL CONDUCTIVE MEMBER 6 [V]
b : DC BIAS ELECTRIC POTENTIAL APPLIED TO ELECTRICAL CONDUCTIVE MEMBER 6 [-V]
e : DISTANCE BETWEEN ELECTRICAL CONDUCTIVE MEMBER 6 AND ELECTROSTATIC CHARGE ROLLER 2 [μm]
f : APPLIED VOLTAGE OF ELECTROSTATIC CHARGE ROLLER [-V]

a : PEAK TO PEAK VOLTAGE OF AC VOLTAGE APPLIED TO ELECTRICAL CONDUCTIVE MEMBER 6 [V]
b : DC BIAS ELECTRIC POTENTIAL APPLIED TO ELECTRICAL CONDUCTIVE MEMBER 6 [-V]
e : DISTANCE BETWEEN ELECTRICAL CONDUCTIVE MEMBER 6 AND ELECTROSTATIC CHARGE ROLLER 2 [μm]
f : APPLIED VOLTAGE OF ELECTROSTATIC CHARGE ROLLER [-V]

IMAGE FORMING APPARATUS FOR MAKING RECOVERY AND RESTORATION OF TONERS BY ELECTRICAL CONDUCTIVE MEMBER

BACKGROUND OF THE INVENTION

1. Field of the Invention

The present invention relates to an image forming apparatus of an electrophotographic type and such as a copying machine, a printer and the like electrostatic recording type.

2. Related Background Art

For an electrifying (or electrostatic charge) device for charging a photosensitive member, there are available a corona electrifying device, a fur brush (see B in FIG. 11), an electrifying roller (see A in FIG. 11) and the like. They are of an electrifying method primarily utilizing electric discharging phenomena.

Instead of such an electric discharging method, an injection charge method for charging without accompanying a discharge is under consideration by directly injecting a charge. With respect to the injection charge method, there is such a method available where an electrical conductive electro-magnetic brush is rubbed against the photosensitive member.

FIG. 11 is a graph showing an example of an electrification efficiency. A bias applied to a contact electrifying member is shown on a transversal axis and a photosensitive member electrification potential is shown on the axis of ordinates.

In the injection charge method, instead of using the magnetic brush method, implementing of the electrification is under consideration by interposing electrical conductive particles (hereinafter referred to as electrification accelerating particles) in the contact portion to accelerate the electrostatic charging by improving the contacting ability by allowing an image bearing member and the contact electrifying member to have a peripheral speed difference.

By this method, it is possible to obtain an electrostatic property equal to or more than that of the electromagnetic brush C as shown in FIG. 11.

When such an electrifying method is used for a cleanerless apparatus, which eliminates the needs for a special cleaner by recovering transfer residual toners by a developing device, an abutting pressure between the contact electrifying member and the image bearing member is increased by interposing the electrification accelerating particles in a contact nip portion between an image bearing member and a contact electrifying member with a contact torque being reduced so that no transfer residual developers pass through the contact nip portion between the contact electrifying member and the image bearing member.

However, if there exist developers which are not transferred on a transferring material, not only the image bearing member but also transfer residual developers should be given a proper charge. When transfer residual developers have an improper charge, transfer residual developers in a developing device can not be recovered and no excellent image quality can be obtained.

Moreover, when the electrification accelerating particles are excessively supplied to the image bearing member, there arises an adverse situation where they are transferred on a print image or they interrupt an image exposure.

SUMMARY OF THE INVENTION

An object of the present invention is to provide an image forming apparatus capable of maintaining an injection chargeability over a long period.

Another object of the present invention is to provide the image forming apparatus with a high recovery efficiency of transfer residual toners by a developing device.

Still another object of the present invention is to provide the image forming apparatus capable of unifying the electrifying polarities of the transfer residual toners.

Still another object of the present invention is to provide an image forming apparatus comprising:

- an image bearing member for bearing an electrostatic image;
- developing means for developing the electrostatic image on the image bearing member by toners charged with a predetermined polarity;
- transfer means for transferring a toner image on the image bearing member to a transferring material;
- charging means for inject-charging the image bearing member having transfer residual toners ;
- an electrical conductive member provided and spaced apart from the above described image bearing member downstream of the above described transfer means and upstream of the above described charging means in the moving direction of the above described image bearing member; and
- electric field forming means for forming an alternating electric field between the above described electrical conductive member and the above described image bearing member.

DESCRIPTION OF THE PREFERRED EMBODIMENTS

Embodiments of the present invention will be described below with reference to the drawings.

Figure 1:
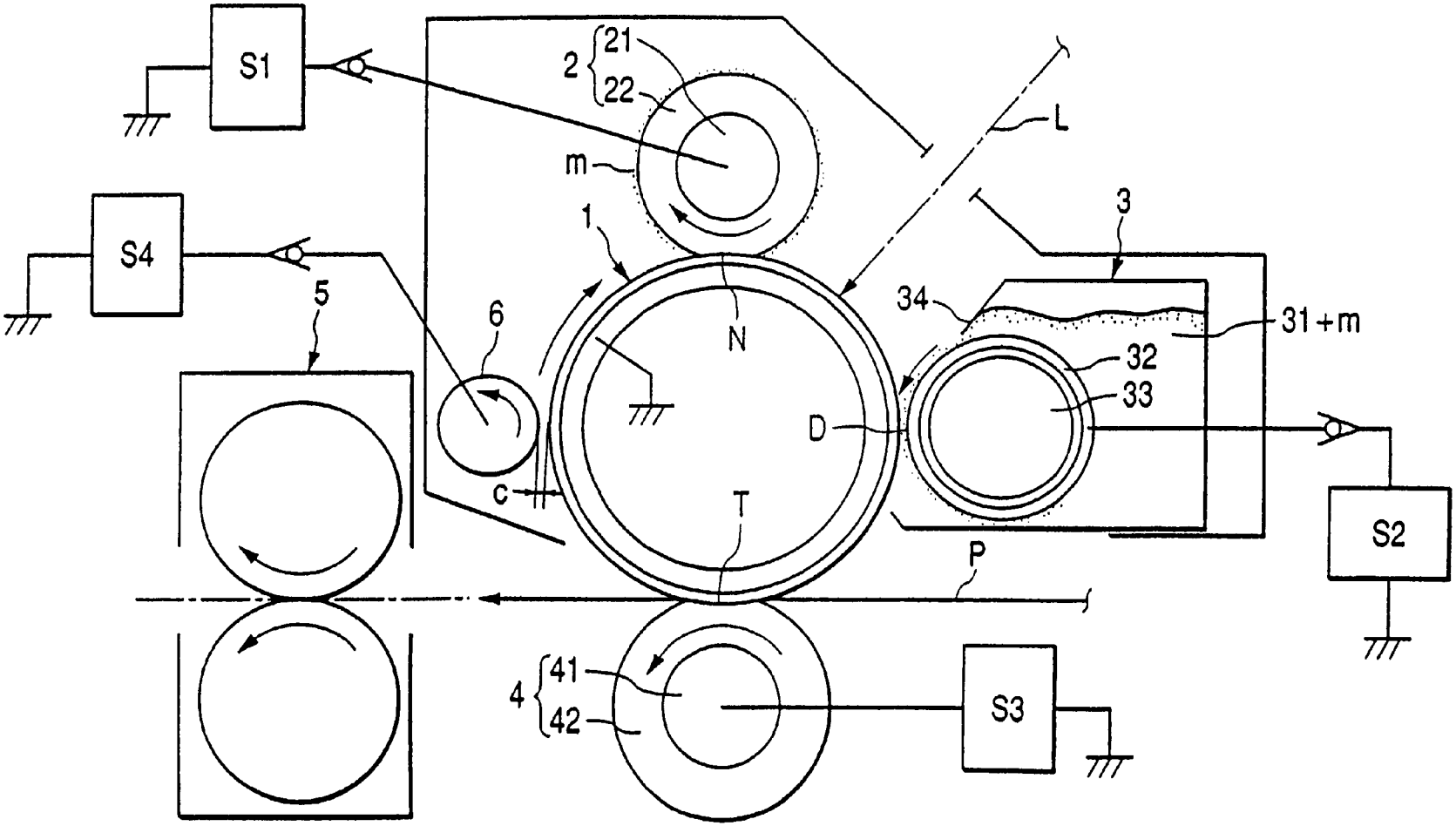
FIG. 1 is a schematic block diagram of the image forming apparatus in embodiment 1.
Figure 2:
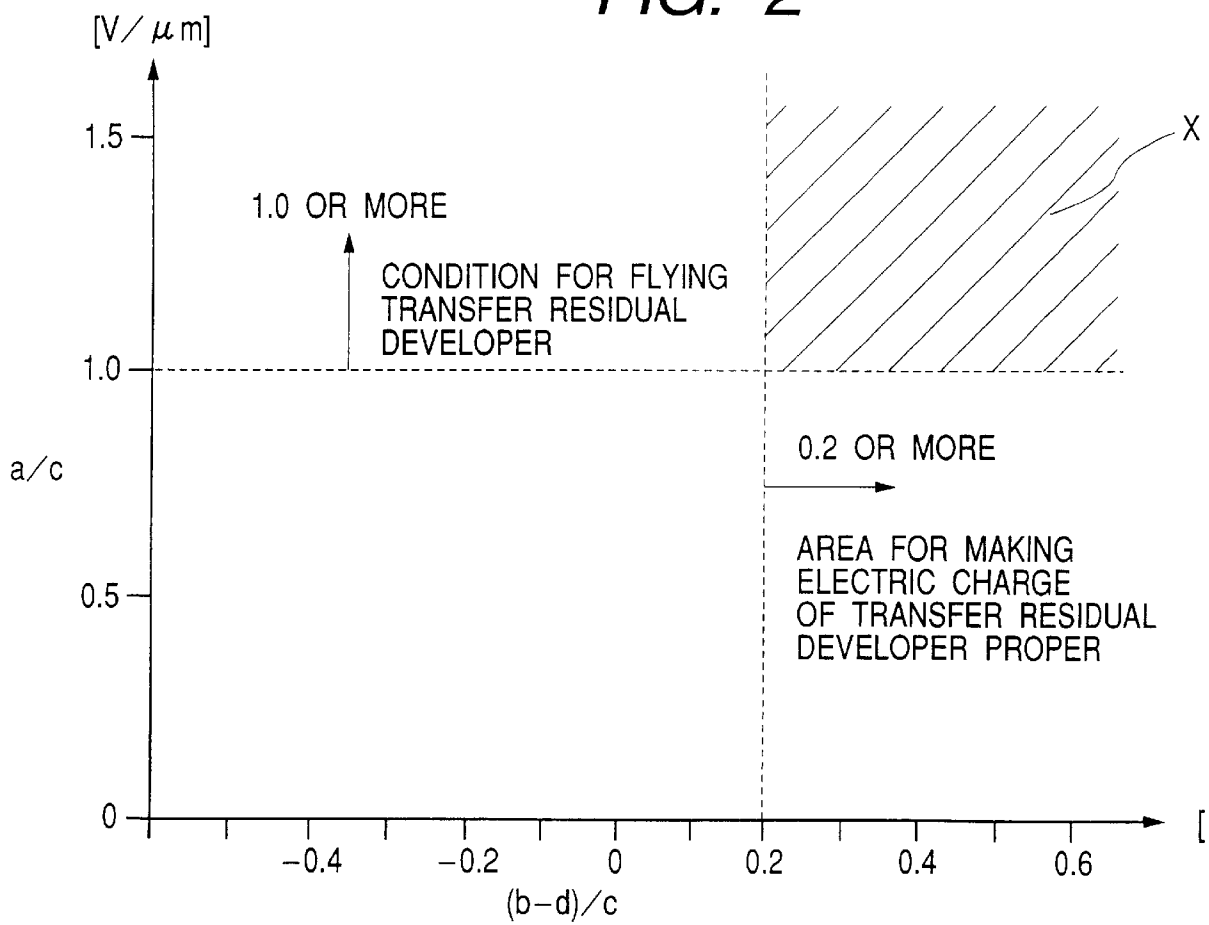
FIG. 2 is an explanatory drawing for the potential condition in the embodiment 1.

<EMBODIMENT 1> (FIG. 1 and FIG. 2)

FIG. 1 is a schematic block diagram model of one example of the image forming apparatus according to the present invention.

The image forming apparatus of the present invention is a laser printer of a transfer type using an electrophotographic print process, a contact electrification type, a reverse noncontact developing type and a cleanerless and process cartridge type.

The contact electrification is implemented such that a electrification accelerating particles m are interposed in an electrifying nip portion N which is a contact portion between a photosensitive member 1 as the image bearing member and an electrifying roller 2 as an contact electrifying member and, by allowing the photosensitive member 1 and the electrifying roller 2 to have a peripheral speed difference, the photosensitive member 1 and the electrifying roller 2 are closely contacted.

Moreover, in this embodiment, the electrification accelerating particles m are mixed with developers 31 of a developing apparatus 3 (developing device) so that the electrification accelerating particles m are supplied through a photosensitive surface to the electrifying nip portion D from the developing apparatus 3 and placed noncontact-wise in close proximity to a photosensitive surface between the transfer portion T and the electrifying nip portion N with an aluminum rod coated with carbon as an electrical conductive member 6 provided there.

And to this aluminum rod as the electrical conductive member 6, a voltage superimposed with an alternative current and a direct current is applied. In this manner, transfer residual developers having an improper charge are recovered non-contact-wise on the surface of the aluminum rod and restored to the surface of the photosensitive member 1 after being charged properly. After this, they can be recovered again inside the developing apparatus 3 through the electrifying roller 2.

Thus, the surface of the photosensitive member 1 is electrostatically charged excellently and transfer residual developers having an improper charge are given a proper charge and the recovery efficiency of transfer residual developers for the developing apparatus 3 is enhanced, thereby an excellent image can be obtained.

(1) OVERALL SCHEMATIC CONFIGURATION OF THE PRESENT EXAMPLE OF PRINTER

[Image bearing member]

Reference numeral 1 denotes an electrophotographic photosensitive member of a rotary drum type as an image bearing member (electrified member). The printer of this embodiment uses a reversal developing, and the photosensitive member 1 uses a negative photosensitive member. The photosensitive member 1 of this embodiment is an OPC photosensitive member having a diameter of 30 mm and is rotatingly driven at a peripheral speed of 94 mm/sec clockwise in the direction shown by the arrow.

[Electrifying]

Reference numeral 2 denotes an electrical conductive elastic roller (electrifying roller) having a diameter of 12 mm as a flexible contact electrifying member which is provided to contact the photosensitive member 1 with a predetermined abutting pressure. N denotes the nip portion between the photosensitive member 1 and the electrifying roller 2. This electrifying roller 2 is coated and borne in advance with the electrification accelerating particles m on its peripheral surface and there exist the electrification accelerating particles m in the electrifying nip portion N.

In this embodiment, the electrifying roller 2 is rotatingly driven at a peripheral speed of 100% in a direction opposite (counter) to the rotating direction of the photosensitive member 1 in the electrifying nip portion N and contacts the photosensitive member 1 at a speed difference. To this electrifying roller 2, a predetermined electrification bias is applied from an electrification bias power source S1. In this manner, the peripheral surface of the rotary photosensitive member 1 is uniformly and contact-electrified to a predetermined polarity and potential by a charge injection method.

In this embodiment, the electrification bias is applied to the electrifying roller 2 from the electrification bias power source S1 so that the outer peripheral surface of the photosensitive member 1 is uniformly charged with −680 V. In this embodiment, the potential applied to the electrifying roller 2 is −700 V.

The electrifying roller 2 is created by forming a medium resistance layer 22 of rubber or foaming member on a core bar 21. The medium resistance layer 22 was treated with resin (for example, urethane), electrical conductive particles (for example, carbon black), sulfide agent, foaming agent and the like, and was formed roller-like on the core bar 21. After this, its surface was polished.

The value of the resistance of the electrifying roller 2 was measured as follows. That is, the photosensitive member 1 of the printer is replaced by a drum made of aluminum. After this, a voltage of 100 V is applied between the aluminum drum and the electrifying roller 2 and, by measuring the value of a current flowed at this time, the value of the resistance of the electrifying roller 2 was determined.

The value of the resistance of the electrifying roller 2 used in this embodiment was $5\times10^6$ Ω. This measurement was conducted under environmental conditions of 25° C. in temperature and 60% in humidity. With regard to the measurement environment, it is identical to this embodiment as well as with other embodiments.

The average cell diameter of 20 μm in the surface of the electrifying roller 2 was used for each value of the resistance. The average cell diameter was measured by an observation by an optical microscope.

[Exposure]

A scanning exposure L is implemented on the electrified surface of the rotaty photosensitive member 1 by a laser beam outputted from a laser beam scanner (not shown) including laser diodes, polygon mirrors and the like. The laser beam outputted from the laser beam scanner is modulated in intensity corresponding to time series electric digital picture elements of an object image information and, through the scanning exposure L by this laser beam, an electrostatic latent image corresponding to the object image information is formed on the outer peripheral surface of the rotary photosensitive member 1.

[Development]

Reference numeral 3 denotes a developing apparatus (developing device). This developing apparatus 3 is a reverse noncontact developing apparatus using a negatively electrified magnetic one composition insulating developers having an average diameter of 6 μm as developers 31. The above described electrostatic latent image formed on the outer peripheral surface of the rotary photosensitive member 1 is developed in reverse as a developer image (toner image) by this developing apparatus 3.

The developers 31 are mixed (applied outside, blended) with the electrification accelerating particles m.

Reference numeral 32 denotes a nonmagnetic developing sleeve containing a magnet 33 and having a diameter of 16 mm. This developing sleeve 32 is coated with the above-described developers 31 (+m) and is made rotated at the speed equal to that of the photosensitive member 1 with the distance from the surface of the photosensitive member 1 being fixed to 500 μm. A developing bias voltage is applied to the developing sleeve 32 from a developing bias power source S2.

The developers 31 (+m) are regulated in layer thickness by an elastic blade 34 (regulating blade) during the process of being conveyed on a rotary developing sleeve 32 and are rubbingly charged by rubbing against the elastic blade 34, thereby having a charge.

The developing bias is 1.6 kHz in frequency, 1.7 kV in peak to peak voltage and −350 V in developing bias DC composition, and one composition jumping development is implemented at a developing portion between the developing sleeve 32 and the photosensitive member 1. The developing bias is not necessarily limited to the above.

a) Developers 31

The developers 31 used in this embodiment were those having hydrophobic silica particles applied outside 0.8% to a developer weight portion to give a fluidity in the insulating developers having a volume resistivity of about $10^{13}$ Ω.cm which contains 60% by weight of magnetite and 1% by weight of metallic complex salt of monoazo dye as a negative charge control material in binding resin mainly comprising styrene acryl copolymer.

As described above, the developers 31 are mixed with the electrification accelerating particles m and the mixed amount is 2 parts by weight as against 100 parts by weight of the developers.

b) Electrifying accelerating particles m

In this embodiment, the electrification accelerating particles m used were electrical conductive zinc oxide particles having a specific resistance of $10^7$ Ω.cm and an average particle diameter of 1 μm.

If the particles are configured as an agglomerate body, the particle diameter was defined as an average particle diameter as the agglomerate body. The measurement of the particle diameter was conducted in such a manner that more than 100 particles were extracted by the observation by an electron microscope and a volume particle size distribution was calculated on the basis of a horizontal maximum length, thereby defining an 50% average particle diameter as the particle diameter.

The measurement of resistance was made, regulated and determined according to a tablet method. That is, a powder sample of about 0.5 g was put inside a cylinder having the base area of 2.26 $cm^2$ and, to the upper and lower electrodes, a pressurization of 15 kg was given and simultaneously a voltage of 100 V was applied, thereby calculating the value of resistance and then the specific resistance after being regulated.

The electrification accelerating particles m are suitable if they are achromatic or white colored non-magnetic particles so as not cause any interruption at the time of a latent image exposure. Moreover, unless the diameter of the particles is about less than half of the diameter of the particles of the developers 31, there was often the case where the image exposure was interrupted. For this reason, it should be smaller than that.

As a material of the electrification accelerating particles m, electrical conductive zinc oxide particles were used, but it is not limited to this material. As the material of the particles, the electrical conductive inorganic particles such as other types of metallic oxide and the like or various types of electrical conductive particles such as mixtures with organic matters and the like can be used.

[Transfer]

Reference numeral 4 denotes a transfer roller of medium resistance as a contact transfer means, where a transfer nip portion T is formed by pressing against the photosensitive member 1 in a predetermined manner. To this transfer nip T portion, a transferring material P as a recorded member is fed from a sheet feeding portion not shown at a predetermined timing and, by applying a predetermined transfer bias voltage to the transfer roller 4 from a transfer bias power source S3, a developing image at the side of the photosensitive member 1 is transferred sequentially to the surface of the transferring material P fed to the transfer tip portion T.

The transfer roller used in this embodiment is a roller having a core bar 41 formed with medium resistance foaming layer 42 and a roller resistance of $5\times10^8$ Ω, and a transfer was implemented by applying +3000 V of a DC voltage to the core bar 41. The transferring material P introduced to the transfer nip portion T is nippingly conveyed and the developing image formed and borne on the surface of the rotary photosensitive member 1 on the surface side is sequentially transferred by an electrostatic force and a pushing force.

[Fixation]

Reference numeral 5 denotes a fixing apparatus of thermal fixing method and the like. The transferring material P fed to the transfer nip portion T and given the transfer of a developer image of the photosensitive member 1 side is separated from the surface of the rotary photosensitive member 1 and introduced to the fixing apparatus 5 and receives the fixing of the developer image and is discharged outside of the apparatus as an image formed matter (print, copy).

[Non-contact electrifying member]

Reference numeral 6 denotes an electrical conductive member, which is placed in close proximity to the surface of the photosensitive member between the transfer portion T and the electrifying nip portion N and arranged approximately in parallel with the photosensitive member.

The electrical conductive member 6 in this embodiment is a rod (aluminum) having a diameter of 8 mm and, on the surface of the aluminum rod, silicon resin dispersed with carbon black was coated. Moreover, by projecting a spacer roller at its end toward the surface of the photosensitive member, an alienating distance c between the electrical conductive member 6 and the photosensitive member 1 was set at 500 μm.

Moreover, the electrical conductive member 6 is rotatingly held in a bearing so as to slave the rotation of the photosensitive member 1.

To this electrical conductive member 6, a rectangle wave having a peak to peak voltage of 1600 V, a frequency of 500 Hz and a DC composition of −900 was applied from the bias applying power source S4.

The role of this conductive member will be described in a paragraph (3).

[Cartridge]

The printer of this embodiment has four pieces of process equipment such as the photosensitive member 1, the contact electrifying member 2, the developing apparatus 3 and the noncontact conductive member 6 contained in a common cartridge and is taken as a collectively detachable attachable cartridge PC against the printer main body. The combination of the process equipment and the like is not limited to the above.

(3) OPERATION OF ELECTRIFYING ACCELERATING PARTICLES m AND NONCONTACT ELECTRICAL CONDUCTIVE MEMBER 6

As described above, in this embodiment, the electrifying roller 2 is coated with the electrification accelerating particles m in advance. Moreover, the developing apparatus 3 has its developers 31 mixed with the electrification accelerating particles m.

The electrification accelerating particles m mixed with the developers 31 inside the developing apparatus are rubbed against the developers 31. In this embodiment, since the developers 31 are applied outside with the negative charge control material, the electrification accelerating particles m are rubbingly charged with it and have a charge on the plus side of a reverse polarity. For this reason, the electrification accelerating particles m in the developer 31 on the developing sleeve 32 are supplied to the surface of the photosensitive member 1 from above the developing sleeve 32 due to the potential difference between the developing sleeve 32 and the surface of the photosensitive member 1.

Since the electrification accelerating particles m have a charge which is the reversal of the polarity of the developers 31, they are substantially not transferred on the transferring material P in the transfer portion T, but supplied to the electrifying nip portion N which is the contact portion between the electrifying roller 2 and the photosensitive member 1 through a proximity alienating portion c between the photosensitive member 1 and the electrical conductive member 6 and, as a result, are coated on the surface of the electrifying roller 2.

In this manner, the electrification accelerating particles m are adhered to the surface of the electrifying roller 2 so that the electrification accelerating particles m are interposed between the electrifying roller 2 and the surface of the photosensitive member 1, thereby enhancing a contact density. For this reason, an excellent inject electrification property can be obtained.

The developers (transfer residual developing materials) remained on the surface of the photosensitive member 1 without being transferred on the transferring material P in the transfer portion T are, while being adhered to the surface of the photosensitive member 1, conveyed to the electrifying nip portion N which is the contact portion between the electrifying roller 2 and the photosensitive member 1. Different from the cleanerless image forming apparatus used in this embodiment, even in the image forming apparatus having a member (cleaner) for cleaning the surface of the photosensitive member 1 after the transfer portion T, there exists some, if any, of the developers which pass through the cleaning member. Thus, it is the same as this embodiment.

With the charging method as used in this embodiment, the electrifying roller 2 is allowed to rotate in the opposite direction of the photosensitive member 1 so as to have the peripheral speed difference of the photosensitive member 1 and the electrifying roller 2.

Here, in the cleanerless image forming apparatus which is not provided with the noncontact electrical conductive member 6 as a comparative (conventional) example of the image forming apparatus, the developers which were not transferred at the transfer portion T are, after being conveyed to the position of the electrifying nip portion N which is the contact portion between the photosensitive member 1 and the electrifying roller 2, adhered on the surface of the electrifying roller 2. The transfer residual developers 31 are, while being adhered on the surface of the electrifying roller 2, allowed to rotate a little less than one round on the electrifying roller 2 and restored to the surface of the photosensitive member 1 just before entering the electrifying nip portion N which is the contact portion between the photosensitive member 1 and the electrifying roller 2.

The point where transfer residual developers move from the surface of the photosensitive member 1 to the surface of the electrifying roller 2 is just before the electrifying nip portion N and there exist practically no transfer residual developers which pass through the electrifying nip portion N.

In order to recover the transfer residual developers in the developing apparatus 3, it is necessary to give a proper charge to the transfer residual developers. With the electrostatic charging method using the electrification accelerating particles m, a contact is made between the electrification accelerating particles m and the developers 31 on the electrifying roller 2 and thereby the charge can be given to the developers. Thus, in the image forming apparatus of this comparative example too, the giving of the proper charge to the transfer residual developers can be implemented. However, there is no saying that it is sufficiently enough.

In contrast, in this embodiment, since the electrical conductive member 6 is arranged approximately in parallel with the photosensitive member noncontact wise in close proximity to the surface of the photosensitive member between the transfer portion T and the electrifying nip portion N and an alternative current bias composition is applied to this electrical conductive member 6, the transfer residual developers 31 adhered on the surface of the photosensitive member 1 fly between the photosensitive member 1 and this electrical conductive member 6.

The developers charged with a plus polarity which is an improper charge polarity adhere to the white matter portion of the surface of the photosensitive member 1. The potential of the white matter portion after the transfer of the photosensitive member 1 is set at a little less than −680 V which is the electrification fixing potential. In contrast to this, since the electrical conductive member 6 has −900 V as an average potential, the transfer residual developers 31 having a plus charge polarity move from the surface of the photosensitive member 1 to the surface of the electrical conductive member 6.

After this, the developers 31 restored to the proper polarity through rubbing against the surface of the electrical conductive member 6 coated with carbon are restored to the surface of the photosensitive member 1.

The developers 31 restored to the surface of the photosensitive member 1 are recovered again (recovery implemented simultaneously with development) inside the developing apparatus 3 through electrifying roller 2. At this time, since the charge polarity of the developers is properly restored, the re-recovery at the developing apparatus 3 can be implemented without any problem.

By going through such steps, this embodiment makes the charge polarity of transfer residual developers 31 proper and re-recover the properly restored developers alone inside the developing apparatus 3 through the electrifying roller 2.

With regard to the electrification accelerating particles m, since they have a plus charge, there is some, if any, of the particles which adheres to the electrical conductive member 6. However, after this, it flies to the surface of the photosensitive member 1 from the surface of the electrical conductive member 6 by a charge injected and is supplied to the surface of the electrifying roller 2.

The above behaviors of the transfer residual developers 31 and the electrification accelerating particles m can be confirmed by a visualization method referred to as a laser sheet method. To be concrete, a planar laser beam is irradiated at the charge portion in the cross sectional direction of the process and the movement of the particles is measured by a sensitive high speed camera, thereby making it possible to confirm the above-described behaviors.

(4) TEST

Next, what difference there is in a practical print image between the image forming apparatus of this embodiment where the noncontact electrical conductive member 6 is arranged and the image formatting apparatus of the comparative example where the noncontact electrical conductive member is not arranged will be shown below.

<1> COMPARATIVE TEST 1

With respect to the charge of the transfer residual developers which were discharged from the surface of the electrifying roller 2 after passing through the electrifying nip portion N and restored to the surface of the photosensitive member 1, how different they are between the image forming apparatus of this embodiment and the image formatting apparatus of the comparative example was measured.

This comparative test was conducted on the following three types of the toners 31A, 31B and 31C. The result of the comparative test is shown in Table 1.

Toner type 31A:

Wherein hydrophobic silica grain is applied outside 0.8% to the developer weight portion in order to give a fluidity to insulating developer having a volume resistibility of approximately $10^{13}$ Ω.cm which contains 60 weight % of magnetite and 1 weight % of metallic complex salt of monoazo dye as a negative charge control material in binding resin mainly comprising styrene acryl copolymer.

Toner type 31B:

Wherein metallic complex salt of a monoazo dye which is a negative charge control material is changed to 1.1% by weight in the above described toner type 31A.

Toner type 31C:

Wherein metallic complex salt of a monoazo dye which is a negative charge control material is changed to 0.9% by weight in the above described toner type 31A.

TABLE 1

| | Toner charge [charge (μc)/weight (mg)] | |
|---|---|---|
| Toner type | Embodiment 1 | Comparative example |
| 31A | −12 | −5 |
| 31B | −15 | −5 |
| 31C | −9 | +1 |

As will be clear from this table, in contrast to the comparative example, this embodiment can give a proper polarity and a high number of charge quantities to the transfer residual developers, making the number of charge quantities properly.

In contract to the above, in the comparative example, there is some, if any, of the developer which has an improper polarity as in case of the toner type 31C. Moreover, as is observable from either type of the toners 31A and 31B, it does not reach a proper number of charge quantities and the number of charge quantities is small.

<2> COMPARATIVE TEST 2

In order to check the difference of the recoverability of the transfer residual developers in the developing apparatus 3 between this embodiment and the comparative example having the above described differences, the following comparison was conducted.

That is, a solid black image is printed one round around the drum of the photosensitive member and, after this, replaced by a sold white image. Immediately after this, the amount of the developers on the surface of the photosensitive member 1 after having passed through the developing apparatus 3 (developing portion D) was compared.

The amount of the developers adhered on the surface of the photosensitive member 1 after having passed through the developing apparatus 3 is:

(1) the transfer residual developers 3, not recoverable in the developing apparatus 3.

(2) if taken as a fog composition which is a background composition naturally carried by the developing apparatus 3, it can be expressed as (1)+(2).

With regard to the fog composition (2), since this embodiment and the comparative example are equal to each other, it can be taken substantially as "the difference between this embodiment and the comparative example of (1)+(2)=the difference between this embodiment and the comparative example of (2)". That is, the difference in the amount of the developers adhered on the surface of the photosensitive member 1 after having passed through the developing apparatus indicates the difference in the recoverability of the transfer residual developers.

The measurement was conducted as follows. By attaching a Mylar tape to the developers adhered on the surface of the photosensitive member 1 after having passed through the above described developing apparatus, the developers are peeled off from the surface of the photosensitive member 1. After this, the Mylar tape is pasted on a white paper. The reflection fog amount of the Mylar tape is measured by a fog amount measuring apparatus TC-6DS made by TOKYO DENSHOKU.

Moreover, the fog amount at the time when the Mylar tape only is pasted on the white paper is also measured, which is taken as a reference reflection fog amount.

By subtracting the measurement value from the reference reflection fog amount, a substantial reflection fog amount is calculated. In this case, the more it is white, that is, the more the amount of transfer residual developers is smaller, the more the value becomes smaller.

As a result of the measurement taken in this manner, in contract to the fog amount of 1.4 of the comparative example, this embodiment results in 0.9. Thus, the fact that the recoverability of the transfer residual developers is enhanced in this embodiment could be confirmed.

Moreover, even in contrast to the ordinary print image, in this embodiment as compared to the comparative example, the fog and the like due to the effect of the transfer residual toners are not detected in the white portion of the print image and thus the improvement of the electrification property and the image property was observed.

<3> MEASUREMENT OF POTENTIAL CONDITION APPLIED TO ELECTRICAL CONDUCTIVE MEMBER 6

Next, a drawing where the potential condition be applied to the electrical conductive member 6 in order to obtain the effect of the improvement of the electrification property and the image property was measured is shown in FIG. 2.

Here, the peak to peak voltage of an alternating voltage applied to the electrical conductive member 6 is taken as a[V], the direct current bias potential applied to the electrical conductive member 6 is taken as b[−V], the distance between the electrical conductive member 6 and the photosensitive member 1 is taken as c[μm], and the photosensitive member electrification potential is taken as d[−V].

In FIG. 2, the transversal axis represents (b−d)/c[−V/μm] and the axis of the ordinates represents a/c[V/μm].

Note that the effect of the DC bias potential applied to the electrical conductive member 6 in the present measurement is, similar to the previous comparison between this embodiment and the comparative example, taken as a basis to see if any improvement is observable in the fog value in the case where the comparison example, i.e., the electrical conductive member 6 is not available.

Moreover, the effect of the peak to peak voltage of the alternating voltage applied to the electrical conductive member 6 was based on whether the flying of the transfer residual developer 31 can be confirmed.

As shown in FIG. 2, it was confirmed that, when a/c is equal to or more than 1[V/μm], the transfer residual developers 31 are flying. The reason is that the electrical field required for the transfer residual developer 31 to fly is considered as 1[V/μm].

Moreover, it was confirmed that, when (b−d)/c is equal to or more than 2[−V/μm], the improvement is observable. The reason is that, when the electrical field of the DC composition of approximately 0.2[−V/μm] is working, only the transfer residual developer 31 having the proper charge is considered restorable on the surface of the photosensitive member 1.

Accordingly, the crosshatched area X as shown in FIG. 2 is the area where the transfer residual developers 31 are allowed to fly from the photosensitive member 1 to the electrical conductive member 6 and, after being recovered there, those having the proper charge can be restored again on the photosensitive member 1 from the electrical conductive member 6.

In this embodiment, a/c is 3.2[V/μm] and (b−d)/c is 44[−V/μm], both of which have the conditions to fall in the effective area.

In this manner, this embodiment is characterized in that, in the image forming apparatus using the charge which allows the electrification accelerating particles m to interpose between the electrifying roller 2 and the photosensitive member 1, the electrical conductive member 6 is placed noncontact-wise in close proximity to the photosensitive member 1 and the voltage is applied where the above described a/c is equal to or more than 1[V/μm] and the above described (b−d)/c is equal to or more than 0.2[−V/μm].

Note that, if a/c is equal to or more than 1[V/μm], the effect of the present invention can be obtained. However, if it is too high, there will be some cases where a dielectric breakdown is caused and hence it is preferable to be equal to or less than 8[V/μm].

In this manner, an excellent electrification property can be maintained and the electrification accelerating particles m adhered to the surface of the photosensitive member 1 are prevented from obstructing the image exposure to adversely affecting the print image.

Figure 3:
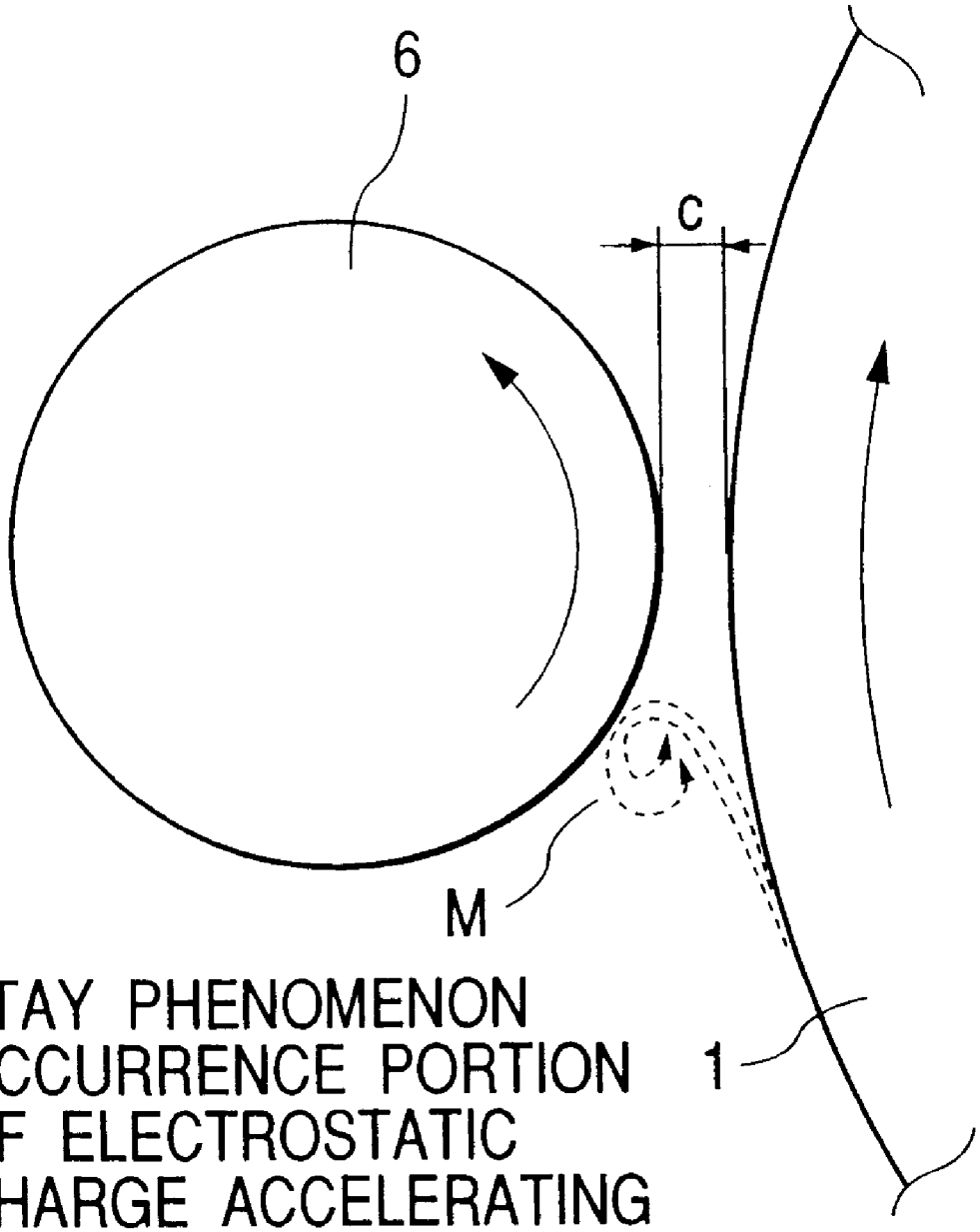
FIG. 3 is an explanatory drawing for the stay phenomenon of electrostatic accelerating particles in embodiment 2.
Figure 4:
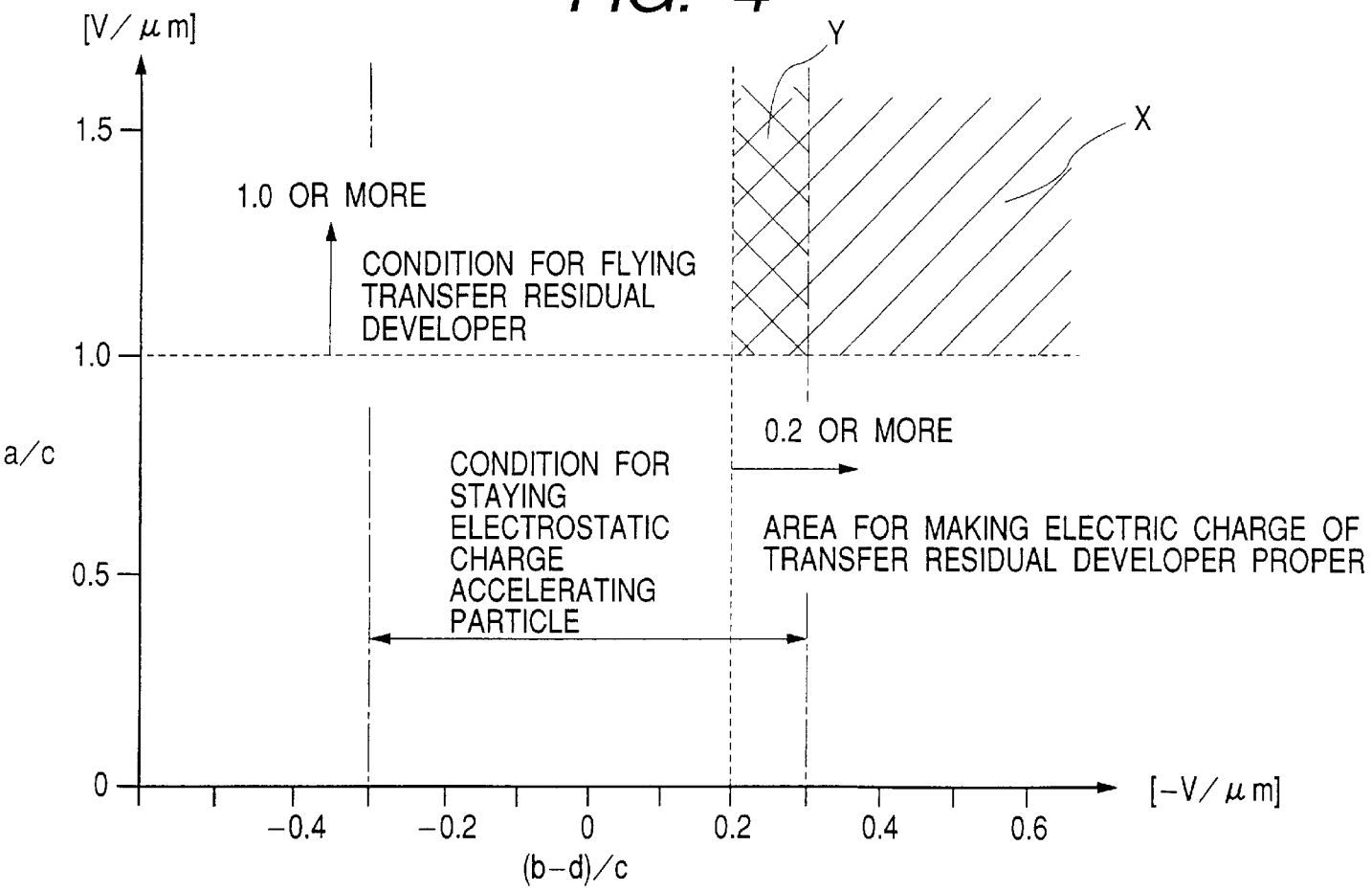
FIG. 4 is an explanatory drawing for the potential condition in the embodiment 2.

<EMBODIMENT 2> (FIG. 3 and FIG. 4)

This embodiment is characterized in that it is approximately the same as the embodiment 1 except that the above described (b−d)/c is equal to or less than 0.3[−V/μm].

In this manner, the electrification accelerating particles m can be held between the electrical conductive member 6 and the photosensitive member 1 and, for this reason, the electrification accelerating particles m are excessively adhered on the surface of the electrifying roller 2 and the electrification accelerating particle m are prevented from being discharged on the surface of the photosensitive member 1.

In this manner, an excellent electrification property can be maintained and the electrification accelerating particles m adhered to the surface of the photosensitive member 1 are prevented from obstructing the image exposure to adversely affecting the print image.

To be concrete, in this embodiment, the difference between the direct current component potential applied to the electrical conductive member 6 and the potential applied to the electrifying roller 2 is smaller than 200 V, which is −800 V as a potential.

In this embodiment, similar to the printer of the embodiment 1, the electrical conductive member 6 is placed noncontact wise opposite to the photosensitive member 1 and, by applying a bias including the alternating current to this electrical conductive member 6, the improper transfer residual developer can be recovered on the electrical conductive member 6 and, after restoring the charge properly, restored to the surface of the photosensitive member 1.

In addition, in the case where the above described (b−d)/c is equal to or less than 0.3[−V/μm], the behavior of the electrification accelerating particles m become different from the embodiment 1.

That is, in the embodiment 1, similar to the developer 31, the electrification accelerating particles m moved from the surface of the photosensitive member 1 to the surface of the electrifying roller 2 and, after this, flied on the surface of the photosensitive member 1 and restored there. However, in the condition of this embodiment where (b−d)/c is equal to or less than 0.3[−V/μm], being different from the above, there emerges some, if any, of the developers which draws a locus as depicted by a broken curve line M in the schematic diagram of FIG. 3. That is, there emerges some, if any, of the electrification accelerating particles m which is no longer able to pass through the proximity alienating portion c between the photosensitive member 1 and the electrical conductive member 6 so that the electrification accelerating particle m begins to stay M in front of the proximity alienating portion c between the photosensitive member 1 and the electrical conductive member 6. Accordingly, there will arise no such situation where an excessive amount of electrification accelerating particles m pass through the proximity alienating portion c between the photosensitive member 1 and the electrical conductive member 6 and thus the electrification accelerating particles m adhere excessively on the surface of the electrifying roller 2 and then, after this, adhere on the surface of the photosensitive member 1.

Note that this measurement is possible to be taken by using the laser sheet method similar to the embodiment 1.

FIG. 4 is a drawing where the potential condition in which such a phenomenon occurs is measured. In FIG. 4, similar to FIG. 2, the transversal axis represents (b−d)/c[−V/μm] and the axis of the ordinates represents a/c[V/μm].

In the case where (b−d)/c is equal to or more than −0.3[−V/μm] and less than 0.3[−V/μm], the electrification accelerating particle m began to stay M as shown in FIG. 3. In this manner, the excessive supply of the electrification accelerating particle m on the surface of the photosensitive member 1 could be prevented.

In this embodiment, since (b−d)/c is 0.24[−V/pm] and equal to or more than 0.2[−V/μm] which is similar to the embodiment 1, the charge of the transfer residual developer was made proper to be equal to or less than 0.3[−V/μm] (that is, the lattice oblique line area Y in FIG. 4) and thus the excessive supply of the electrification accelerating particle m could be prevented.

By the operation as described above, the electrification accelerating particles m adhered on the surface of the photosensitive member 1 will not affect the image exposure harmfully and an excellent print image can be obtained.

<EMBODIMENT 3> (FIG. 5)

The bias for the electrical conductive member 6 can be allowed to have a sequence for fluctuating at least one from the frequency, the amplitude and the direct current component of the alternating voltage to be applied.

This embodiment is approximately the same as the embodiments 1 and 2, which is characterized in that the bias to be applied to the electrical conductive member 6 is made variable at a printing time and a nonprinting time, and which is an image forming apparatus characterized in that, at an image printing time, since (b−d)/c is equal to or more than 0.2[−V/μm] and less than 0.3[−V/μm], the excessive supply of the electrification accelerating particle is controlled while the charge of the transfer residual developer is made proper, and at a nonimage printing time, since the electrification accelerating particles m are supplied to the photosensitive member, (b−d)/c is equal to or more than 0.3[−V/μm].

That is, at the printing time, the same bias as the embodiment 2 is applied to the electrical conductive member 6 and, at the nonprinting time, the same bias as the embodiment 1 is applied.

Figure 5:
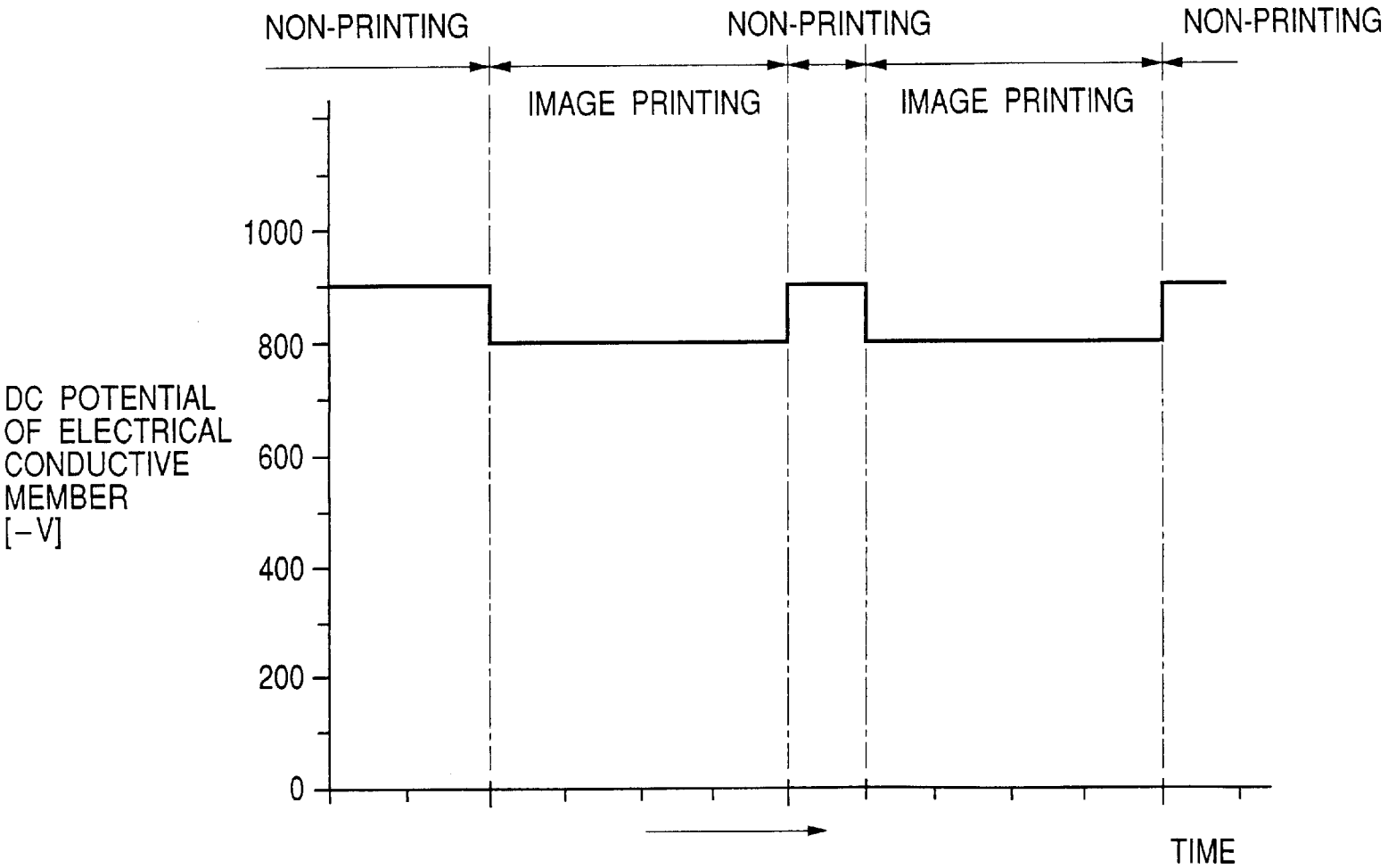
FIG. 5 is an explanatory drawing for the potential sequence in the image forming apparatus of embodiment 3.

The sequence of the DC bias potential for the electrical conductive member 6 is shown in FIG. 5. At the image printing time, similar to the embodiment 2, a rectangular wave having a peak to peak voltage of 1600 V, a frequency of 500 Hz and a DC composition of −800 V is applied and, at the nonprinting time, a rectangular wave having a peak to peak voltage of 1600 V, a frequency of 500 Hz and a DC composition of −900 V is applied.

As shown in FIG. 5, at the image printing time, the DC composition is −800 V, that is, (b−d)/c is 0.24[−V/μm] and, at the nonimage printing time, the DC composition is −900 V, that is, (b−d)/c is 0.44[−V/μm].

In this embodiment, during the image printing time, similar to the embodiment 2, the excessively supplied electrification accelerating particles m are allowed to stay M in the proximity alienating portion c between the electrical conductive member 6 and the photosensitive member 1 as shown in FIG. 3 so that the electrification accelerating particles m are prevented to be supplied excessively on the surface of the photosensitive member 1.

At the nonprinting time, since (b−d)/c becomes larger than 0.3[−V/μm], the stay M of the electrification accelerating particles m as shown in FIG. 3 is not caused, but the accumulated electrification accelerating particles m are discharged and the excessive amount of the electrification accelerating particles m can be recovered inside the developing apparatus 3 through the surface of the photosensitive member 1.

In this embodiment, since the electrification accelerating particles m stay M in front of the proximity alienating portion c between the electrical conductive member 6 and the photosensitive member 1 and have a high number of charge quantities, the re-recovery thereof toward the developing apparatus 3 is possible in a highly efficient manner.

For this reason, the continuous adherence of the electrification accelerating particles m on the surface of the photosensitive member 1 is prevented and an excellent print image can be obtained without affecting the print image harmfully.

Figure 6:
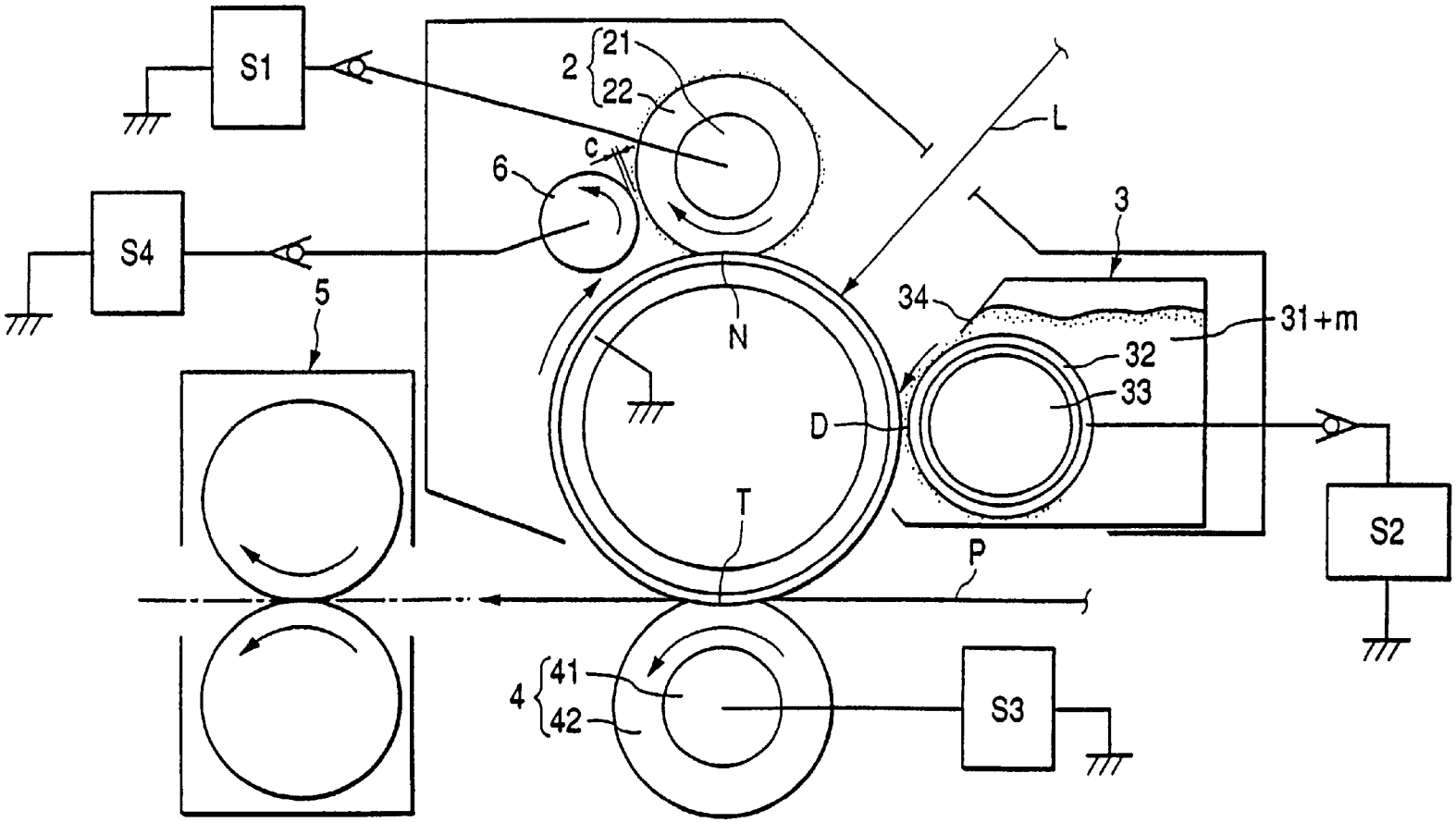
FIG. 6 is a schematic block diagram of the image forming apparatus of embodiment 4.
Figure 7:
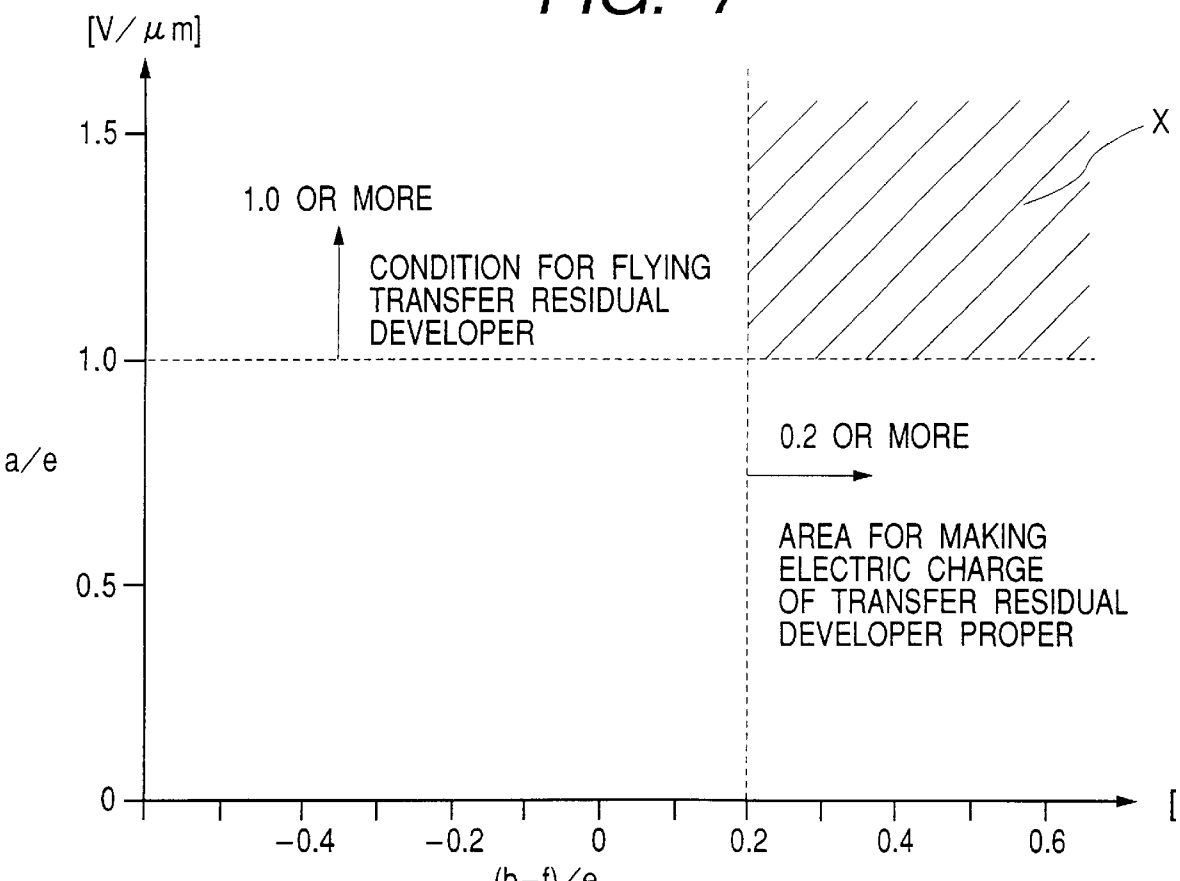
FIG. 7 is an explanatory drawing for the potential condition in the embodiment 4.

<EMBODIMENT 4> (FIG. 6 and FIG. 7)

(1) CONFIGURATION OF IMAGE FORMING APPARATUS

FIG. 6 is a schematic block diagram of the printer in this embodiment.

In contrast to the printer (FIG. 1) of the embodiment 1, the printer in this embodiment has the electrical conductive member 6 placed noncontact-wise in close proximity to the electrifying roller 2. The other configuration of the apparatus is similar to the printer of the embodiment 1 and therefore the description thereof for the second time will be omitted.

That is, in the printer of this embodiment too, the contact electrostatic charging is implemented such that the electrification accelerating particles m are interposed in the electrifying nip portion N which is the contact portion between the photosensitive member 1 as an image bearing member and the electrifying roller 2 as a contact electrifying portion and, by allowing the photosensitive member 1 and the electrifying roller 2 to have a peripheral speed difference, the photosensitive member 1 and the electrifying roller 2 are closely contacted, thereby making the injection charge mechanism to work dominantly. Moreover, the electrification accelerating particles m are mixed with the developers 31 of the developing apparatus 3 so that the electrification accelerating particles m are supplied from the inside of the developing apparatus to the electrifying nip portion N through the surface of the photosensitive member.

In case of this embodiment, the aluminum bar 6 which is the electrical conductive member is arranged approximately in parallel to the electrifying roller 2 noncontact-wise in close proximity to the electrifying roller 2 and applied with the voltage superimposed with the alternating current and the direct current. In this manner, the transfer residual developers having an improper charge is recovered on the surface of the aluminum bar noncontact-wise and can be recovered again inside the developing apparatus 3 through the electrifying roller 2 after being charged properly.

Thus, it is possible to make an excellent charging of the surface of the photosensitive member 1 and give a proper charge to the transfer residual developer having an improper charge and, by enhancing the recoverability of the transfer residual toward the developing apparatus 3, the excellent image can be obtained.

The electrical conductive member 6 in this embodiment is a aluminum bar having a diameter of 8 mm and, on the surface of the aluminum bar, carbon black is dispersed in silicon resin so as to adjust resistance and a surface layer adjusted with a volume resistivity of $10^2$ Ω.cm is arranged. This electrical conductive member 6 is arranged and positioned so as to maintain an alienating distance e of 500 μm with the electrifying roller 2.

Moreover, the electrical conductive member 6 is rotatively held in bearing so as to slave the rotation of the electrifying roller 2.

To this electrical conductive member 6, a rectangular wave having a peak to peak voltage of 1600 V, a frequency of 500 Hz and a DC composition of −900 V was applied from a bias applying power source S4.

In the printer of this embodiment too, similar to the printer of the embodiment 1, the electrifying roller 2 is coated in advance with the electrification accelerating particles m. Moreover, the developing apparatus 3 has the developers 31 mixed with the electrifying accelerating particles m. The electrification accelerating particles m mixed with the developers 31 inside the developing apparatus is rubbed against the developer 31. Since the developers 31 are applied outside with a negative charge control material, the electrification accelerating particles m are frictionally electrified against it so as to have a charge on the plus side of a reverse polarity. For this reason, the electrification accelerating particles m inside the developer 31 on a developing sleeve 32 are supplied on the surface of the photosensitive member 1 from above the developing sleeve 32 due to the potential difference between the developing sleeve 32 and the photosensitive member 1.

Since the electrification accelerating particles m have the charge in reverse to the polarity of the developers 31, they are substantially not transferred to a transferring material P in a transfer portion T, but supplied to the electrifying nip portion T which is a contact portion between the electrifying roller 2 and the photosensitive member 1 and, as a result, coated on the surface of the electrifying roller 2.

In this manner, the electrification accelerating particles m are adhered on the surface of the electrifying roller 2 so that the electrification accelerating particles me are interposed between the electrifying roller 2 and the photosensitive member 1, thereby enhancing a contact density. As a result, an excellent injection electrification property can be obtained.

The developers (transfer residual developers) remained on the surface of the photosensitive member 1 without being transferred to the transferring material P in the transfer portion T are kept adhered on the surface of the photosensitive member 1 and conveyed to the electrifying nip portion T which is the contact portion between the electrifying roller 2 and the photosensitive member 1. Different from the cleaner-less image forming apparatus used in this embodiment, even in the image forming apparatus having a member (cleaner) for cleaning the surface of the photosensitive member 1 after the transfer portion T, there exists some, if any, of the developers which passes through the cleaning portion. Hence it is the same as this embodiment.

With the electrostatic charging method as with this embodiment, the electrifying roller 2 is rotated in the direction opposite to the photosensitive member 1 so as to have the peripheral speed difference between the photosensitive member 1 and the electrifying roller 2.

The developers which were not transferred in the transfer portion T are adhered on the surface of the electrifying roller 2 after being conveyed to the electrifying nip portion T which is the contact portion between the photosensitive member 1 and the electrifying roller 2. The transfer residual developers are kept adhered on the surface of the electrifying roller 2 and rotated a little less than one round on the electrifying roller 2 and restored on the surface of the photosensitive member 1 just before entering the electrifying nip portion N which is the contact portion between the photosensitive member 1 and the electrifying roller 2.

The point where the transfer residual developers move from the surface of the photosensitive member 1 to the electrifying roller 2 is just before the electrifying nip portion T and there exist practically no transfer residual developers which pass through the electrifying nip portion T.

In order to recover the transfer residual developers in the developing apparatus 3, it is necessary to give a proper charge to the transfer residual developers. With the charging method using the electrification accelerating particles m, a contact is made between the electrification accelerating particles m and the developers 31 on the electrifying roller 2 and thereby the charge can be given to the developers. Accordingly, in the image forming apparatus of this comparative example too, the giving of the proper charge to the transfer residual developers can be implemented. However, there is no saying that it is sufficiently enough.

In contrast, in this embodiment, the electrical conductive member 6 is placed noncontact-wise opposite to the electrifying roller 2. Since the alternating current bias composition is applied to this electrical conductive member 6, the transfer residual developers 31 adhered on the surface of the electrifying roller 2 fly between the electrifying roller 2 and this electrical conductive member 6.

A voltage of −700 V is applied to the electrifying roller 2 and, since the direct current component of the electrical conductive member is −900 V, those having a plus charge polarity among the transfer residual developers, that is, the transfer residual developers having an improper charge polarity are adhered on the surface of the electrical conductive member 6. On the contrary, the transfer residual developers having a proper minus charge polarity are, after flying between the electrifying roller 2 and the electrical conductive member 6, adhered on the surface of the electrifying roller 2 and, after this, adhered on the surface of the photosensitive member 1 and recovered inside the developing apparatus 3. Since the charge polarity of the developers 31 is proper, the re-recovery inside the developing apparatus 3 can be made without any problem.

The transfer residual developers having an improper charge polarity adhered on the surface of the electrical conductive member 6 have a minus charge polarity by the rubbing against the surface layer of the electrical conductive member and a charge injection and, after flying between the electrifying roller 2 and the electrical conductive member 6, are discharged on the surface of the electrifying roller 2.

By going through such steps as described above, the charge polarity of the transfer residual developers is made proper and only those properly charged can be re-recovered inside the developing apparatus 3 through the electrifying roller 2.

Note that, since the electrification accelerating particles m have a plus charge, there is a number of those adhering on the surface of the electrical conductive member 6 which, however, after flying from the surface of the electrical conductive member 6 by the charge injection, are supplied to the surface of the electrifying roller 2.

The above described behaviors of the transfer residual developers 31 and the electrification accelerating particles m can be confirmed by the above described laser sheet method.

(2) TEST

In the actual print image, the result confirming what difference there is between the image forming apparatus of this embodiment providing a noncontact electrical conductive member 6 and the image forming apparatus of the comparative example without providing the noncontact electrical conductive member 6 will be shown below.

<1> COMPARATIVE TEST 1

A test on how different is the charge of the transfer residual developers, which was discharged from the surface of the electrifying roller 2 after passing through the electrifying nip portion N and restored on the surface of the photosensitive member 1, between the image forming apparatus of this embodiment and the image forming apparatus of the comparative example was conducted in the similar manner with the comparative test 1 of the above described embodiment 1 with respect to the above described three types of toners (developers) 31A, 31B and 31C. The result of the comparative test will be shown in Table 2.

TABLE 2

| | Toner charge [charge (μc)/weight (mg)] | |
|---|---|---|
| Toner type | Embodiment 4 | Comparative example |
| 31A | −8 | −1 |
| 31B | −9 | −2 |
| 31C | −7 | +1 |

As will be clear from this table, in contrast to the comparative example, this embodiment can give a proper polarity and a high number of charge quantities to the transfer residual developers, making the number of charge quantities properly.

In contrast to the above, in the comparative example, there is some, if any, of the developers which has an improper polarity as in case of the toner type 31C. Moreover, as is observable from either type of the toners 31A and 31B, it does not reach a proper number of charge quantities and the number of charge quantities is small.

<2> COMPARATIVE TEST 2

In order to check the difference of the recoverability of the transfer residual developers in the developing apparatus 3 between this embodiment and the comparative example having the differences as described above, a comparison was made in the same manner as the comparison test 2 in the above described embodiment 1.

As a result of the measurement taken in this manner, in contrast to the fog amount of 1.5 of the comparison example, this embodiment results in 0.9. Thus, the fact that the recoverability of the transfer residual developers is enhanced in this embodiment could be confirmed.

Moreover, even in contrast to the ordinary pint image, in this embodiment as compared to the comparative example, the fog and the like due to the effect of the transfer residual toners are not detected in the white portion of the print image and thus the improvement of the electrification property and the image property was observed.

<3> MEASUREMENT OF POTENTIAL CONDITION APPLIED TO ELECTRICAL CONDUCTIVE MEMBER 6

Next, a drawing where the potential condition be applied to the electrical conductive member 6 in order to obtain the effect of the improvement of the electrification property and the image property was measured is shown in FIG. 7.

Here, the peak to peak voltage of an alternating voltage applied to the electrical conductive member 6 is taken as a[V], the direct current bias potential applied to the electrical conductive member 6 is taken as b[−V], the distance between the electrical conductive member 6 and the photosensitive member 1 is taken as e[μm], and the potential applied to the electrifying roller is taken as f[−V].

In FIG. 7, the transversal axis represents (b−f)/e[−V/μm] and the axis of the ordinates represents a/e[V/μm].

Note that the effect of the DC bias potential applied to the electrical conductive member 6 in the present measurement is, similar to the previous comparison between this embodiment and the comparative example, taken as a basis to see if any improvement is observable in the fog value in the case where the comparison example, i.e., the electrical conductive member 6 is not available.

Moreover, the effect of the peak to peak voltages of the alternating voltage which is applied to the electrical conductive member 6 was based whether the flying of the transfer residual developers 31 can be confirmed.

As shown in FIG. 7, when a/e is equal to or more than 1[V/μm], it was confirmed that the transfer residual developers 31 are flying. The reason is that the electrical field required for the transfer residual developers 31 to fly is considered as 1[V/μm].

Moreover, it was confirmed that, if (b−d)/e is equal to or more than 2[−V/μm] is working, the improvement is observable. The reason is that, if the electrical field of the DC composition of approximately 0.2[−V/μm] is working, only the transfer residual developers 31 having the proper charge are considered restorable on the surface of the photosensitive member 1.

Accordingly, the crosshatched area X as shown in FIG. 7 is the area where the transfer residual developers 31 are allowed to fly from the electrifying roller 2 to the electrical conductive member 6 and, after being recovered there, those having the proper charge can be restored again on the electrifying roller 2 from the electrical conductive member 6.

In this embodiment, a/e is 3.2[V/μm] and (b−f)/e is 44[−V/μm], both of which have the conditions to fall in the effective area.

In this manner, this embodiment is characterized in that, in the image forming apparatus using the charge which allows the electrification accelerating particles m to be interposed between the electrifying roller 2 and the photosensitive member 1, the electrical conductive member 6 is placed noncontact-wise in close proximity to the electrifying roller 2 and the voltage is applied where the above described a/e is equal to or more than 1[V/μm] and (b−f)/e is equal to or more than 0.2[−V/μm].

Note that, if a/e is equal to or more than 1[Vμm], the effect of the present invention can be obtained. However, if it is too high, there will be some cases where a dielectric breakdown is caused and hence it is preferable to be equal to or less than 8[V/μm].

In this manner, the transfer residual developers having an improper charge are adhered on the surface of the electrical conductive member and, after being charged there properly, recovered inside the developing apparatus through the electrifying roller 2, thereby enhancing the recoverability of the developers inside the developing apparatus and enabling to obtain an excellent image property.

Figure 8:
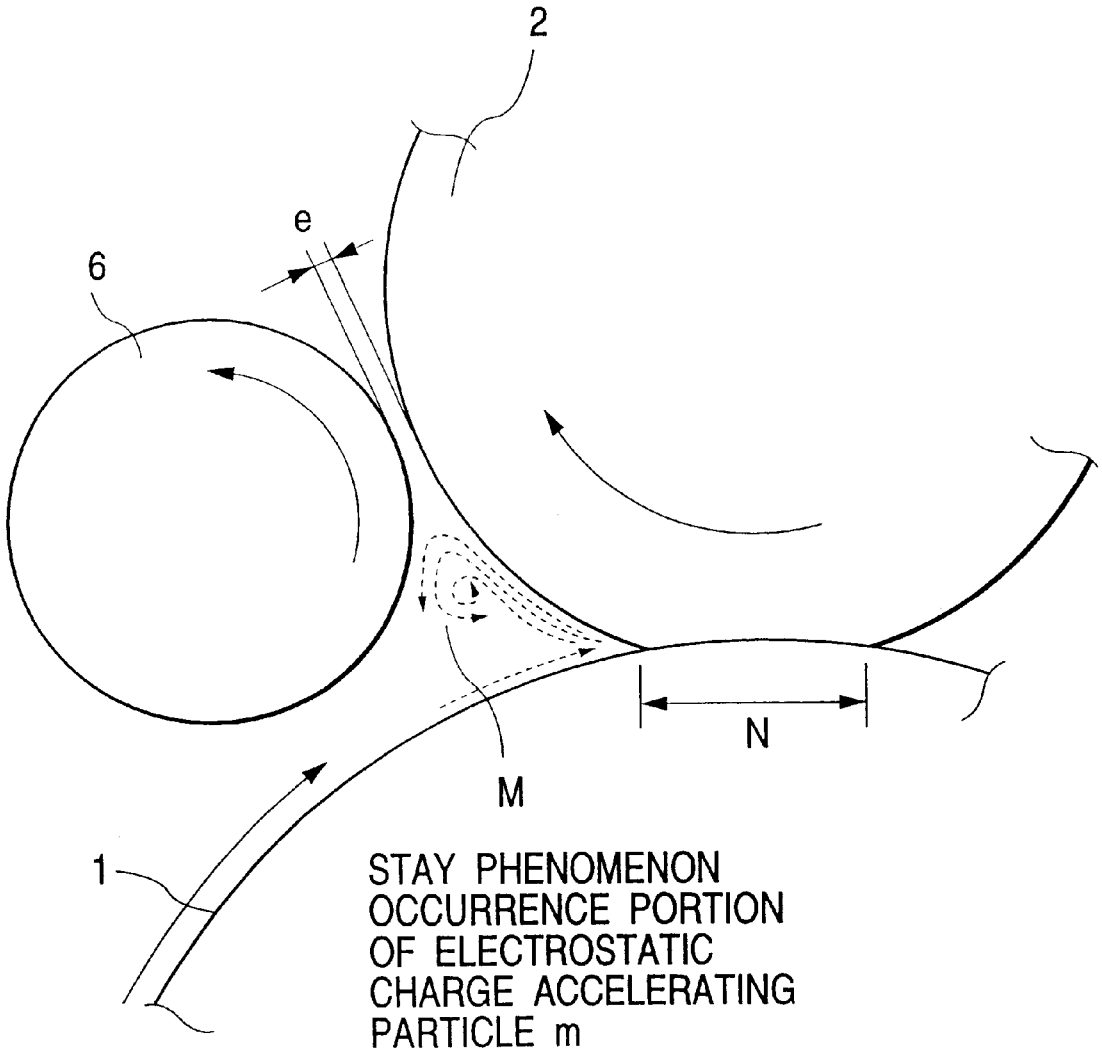
FIG. 8 is an explanatory drawing for the stay phenomenon of electrostatic accelerating particles in embodiment 5.
Figure 9:
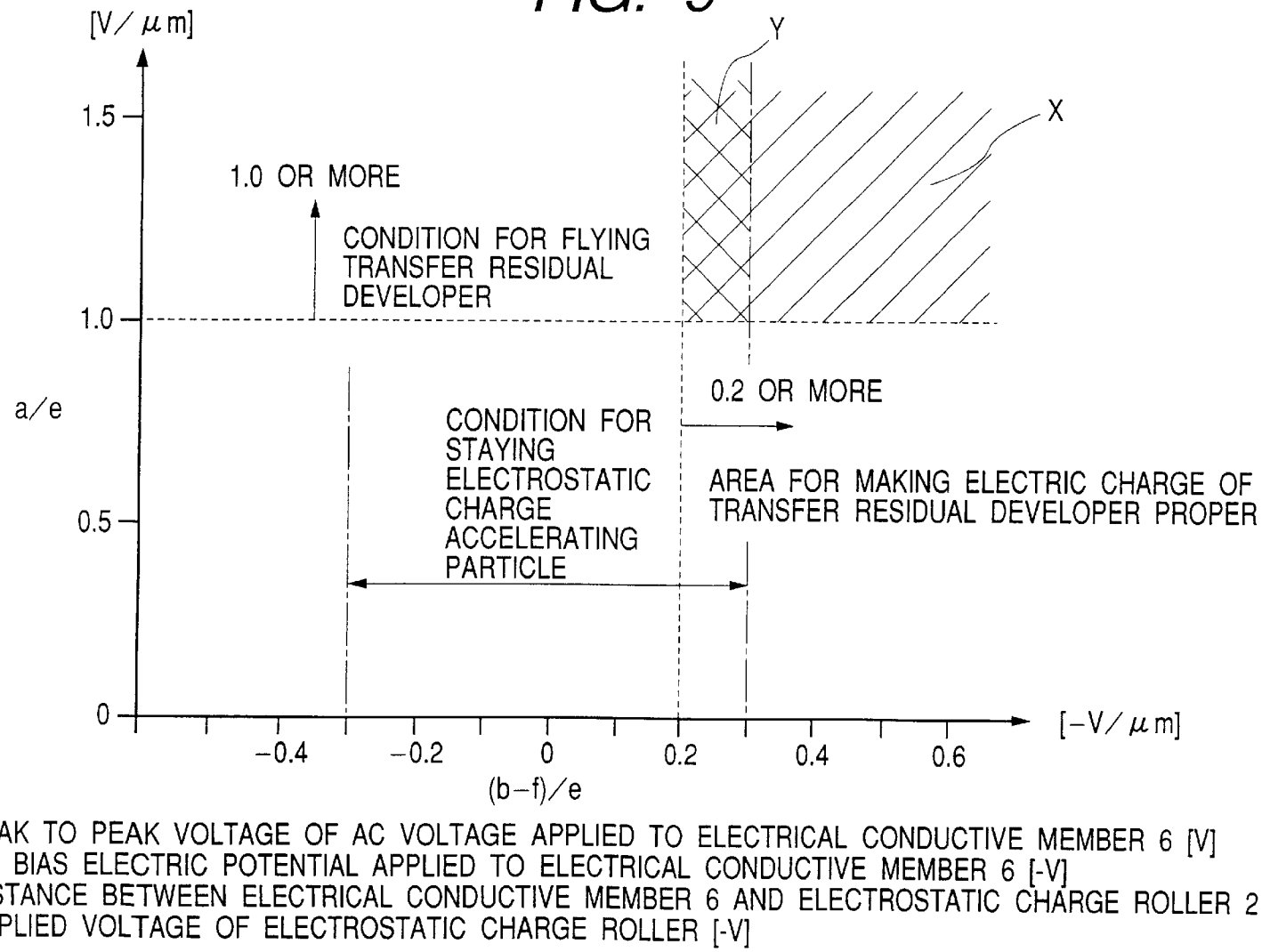
FIG. 9 is an explanatory drawing for the potential condition in the embodiment 5.

<EMBODIMENT 5> (FIG. 8 and FIG. 9)

This embodiment is characterized in that it is approximately the same as the embodiment 4 except that the above described (b−d)/c is equal to or less than 0.3[−V/μm].

In this manner, the electrification accelerating particles m can be held between the electrical conductive member 6 and the electrifying roller 2 and, for this reason, the electrification accelerating particles m are prevented from adhering excessively on the surface of the electrifying roller 2 and being discharged on the surface of the photosensitive member 1.

In this manner, an excellent electrification property can be maintained and the electrifying accelerating particles m adhered to the surface of the photosensitive member 1 are prevented from obstructing the image exposure to adversely affecting the print image.

To be concrete, in this embodiment, the difference between the direct current component potential of the bias applied to the electrical conductive member 6 and the potential applied to the electrifying roller 2 is small than 200 V, which is −800 as a potential.

In this embodiment, similar to the printer of the embodiment 1, the electrical conductive member 6 is placed noncontact-wise opposite to the electrifying roller 2 and, by applying a bias including the alternating current to this electrical conductive member 6, the improper transfer residual developers can be recovered on the electrical conductive member 6 and, after restoring the charge thereof properly, restored to the surface of the electrifying roller 2.

In addition this, in the case where the above described (b−f)/e is equal to or less than 0.3[−V/μm], the behavior of the electrification accelerating particle m becomes different from the embodiment 4.

That is, in the embodiment 4, similar to the developers 31, the electrification accelerating particles m moved from the surface of the photosensitive member 1 to the surface of the electrifying roller 2 and, after this, flied on the surface of the photosensitive member 1. However, in the condition of this embodiment where (b−d)/c is equal to or less than 0.3[−V/μm], being different from the above, there emerges some, if any, of the developers which draws a locus as depicted by a broken curve line M in the schematic diagram of FIG. 8. That is, there emerges some, if any, of the electrification accelerating particles m which is no longer able to pass through the proximity alienating portion e between the electrifying roller 2 and the electrical conductive member 6 so that the electrification accelerating particle m begins to stay M in front the proximity alienating portion e between the electrifying roller 2 and the electrical conductive member 6. Accordingly, there will arise no such situation where an excessive amount of electrification accelerating particles m pass through the proximity alienating portion e between the electrostatic roller 2 and the electrical conductive member 6 and thus the electrification accelerating particles m adhere excessively on the surface of the electrifying roller 2 and then, after this, adhere on the surface of the photosensitive member 1.

Note that this measurement is possible to be taken buy using the above described laser sheet method.

FIG. 9 is a drawing where the potential condition in which such a phenomenon occurs is measured. In FIG. 9, similar to FIG. 7, the transversal axis represents (b−f)/e [−V/μm] and the axis of the ordinates represents a/f[V/m].

In the case where (b−f)/c is equal to or more than −0.3[−V/μm] and less than 0.3[−V/μm], the electrification accelerating particles m began to stay M as shown in FIG. 8. In this manner, the excessive supply of the electrification accelerating particles m on the surface of the photosensitive member 1 could be prevented.

In this embodiment, since (b−f)/c is 0.24[−V/μm] and equal to or more than 0.2[−V/μm] which is similar to the embodiment 4, the charge of the transfer residual developers was made proper to be equal to or less than 0.3[−V/μm] (that is, the lattice oblique line area Y in FIG. 9) and thus the excessive supply of the electrification accelerating particles m could be prevented.

By the operation as described above, the electrostatic charge accelerating particles m adhered on the surface of the photosensitive member 1 will not affect the image exposure harmfully and an excellent print image can be obtained.

<EMBODIMENT 6> (FIG. 10)

The bias for the electrical conductive member 6 can be allowed to have a sequence for fluctuating at lease one from the frequency, the amplitude and the direct current component of the alternating voltage to be applied.

This embodiment is approximately the same as embodiment 3 and 4, which is characterized in that the bias to be applied to the electrical conductive member 6 is made variable to the electrical conductive member 6 is made variable at a printing time and a nonprinting time, and which is an image forming apparatus characterized in that, at an image printing time, since (b−f)/e is equal to or more than 0.2[−V/μm] and less than 0.3[−V/μm], the excessive supply of the electrification accelerating particles is controlled while the charge of the transfer residual developers is made proper, and at a nonimage printing time, since the electrification accelerating particles are supplied to the photosensitive member, (b−f)/e is equal to or more than 0.3[−V/μm].

That is, at the image printing, the same bias as the embodiment 5 is applied to the electrical conductive member 6 and, at the nonprinting time, the same bias as the embodiment 4 is applied.

Figure 10:
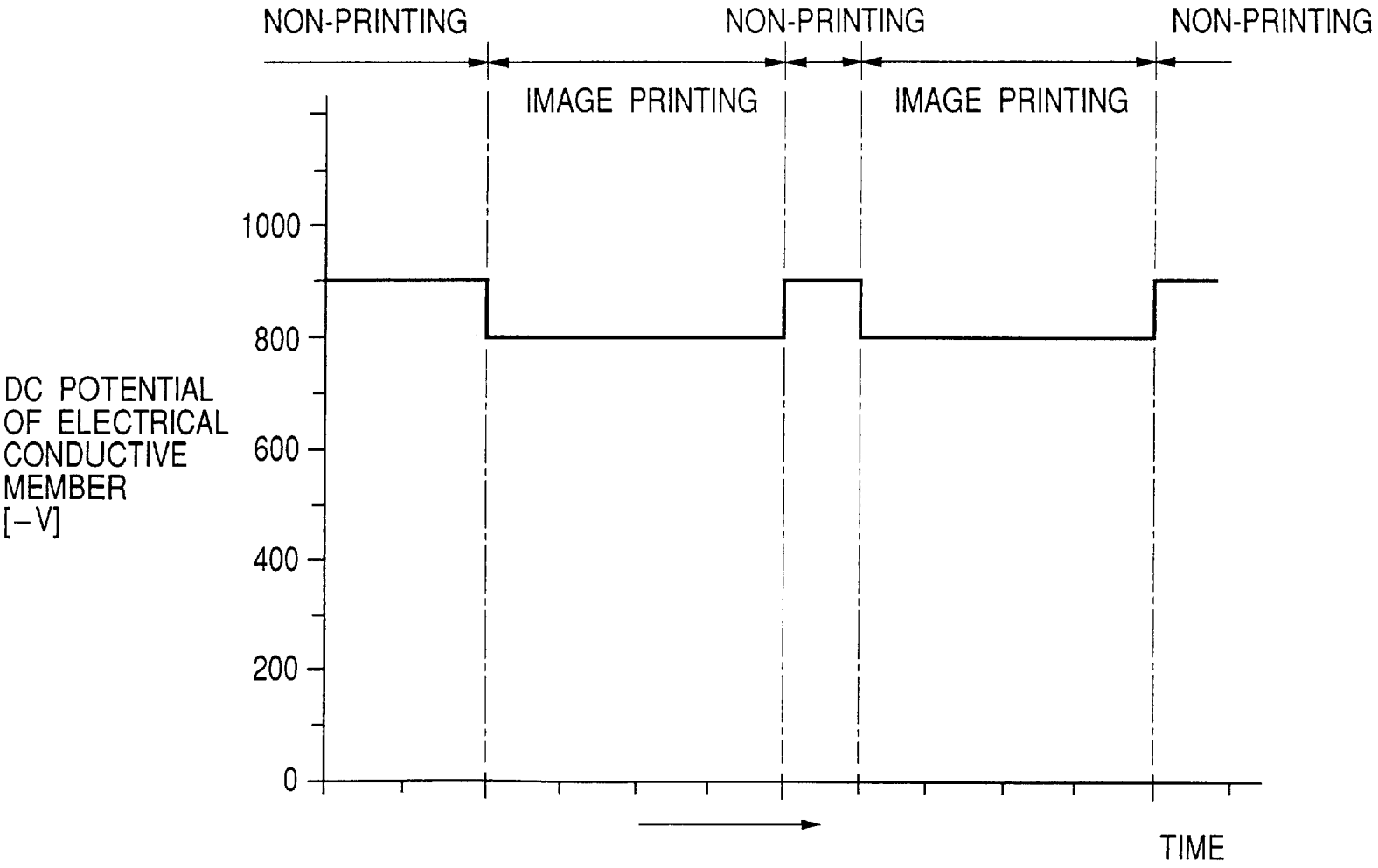
FIG. 10 is an explanatory drawing for the potential sequence in the image forming apparatus of embodiment 6.
Figure 11:
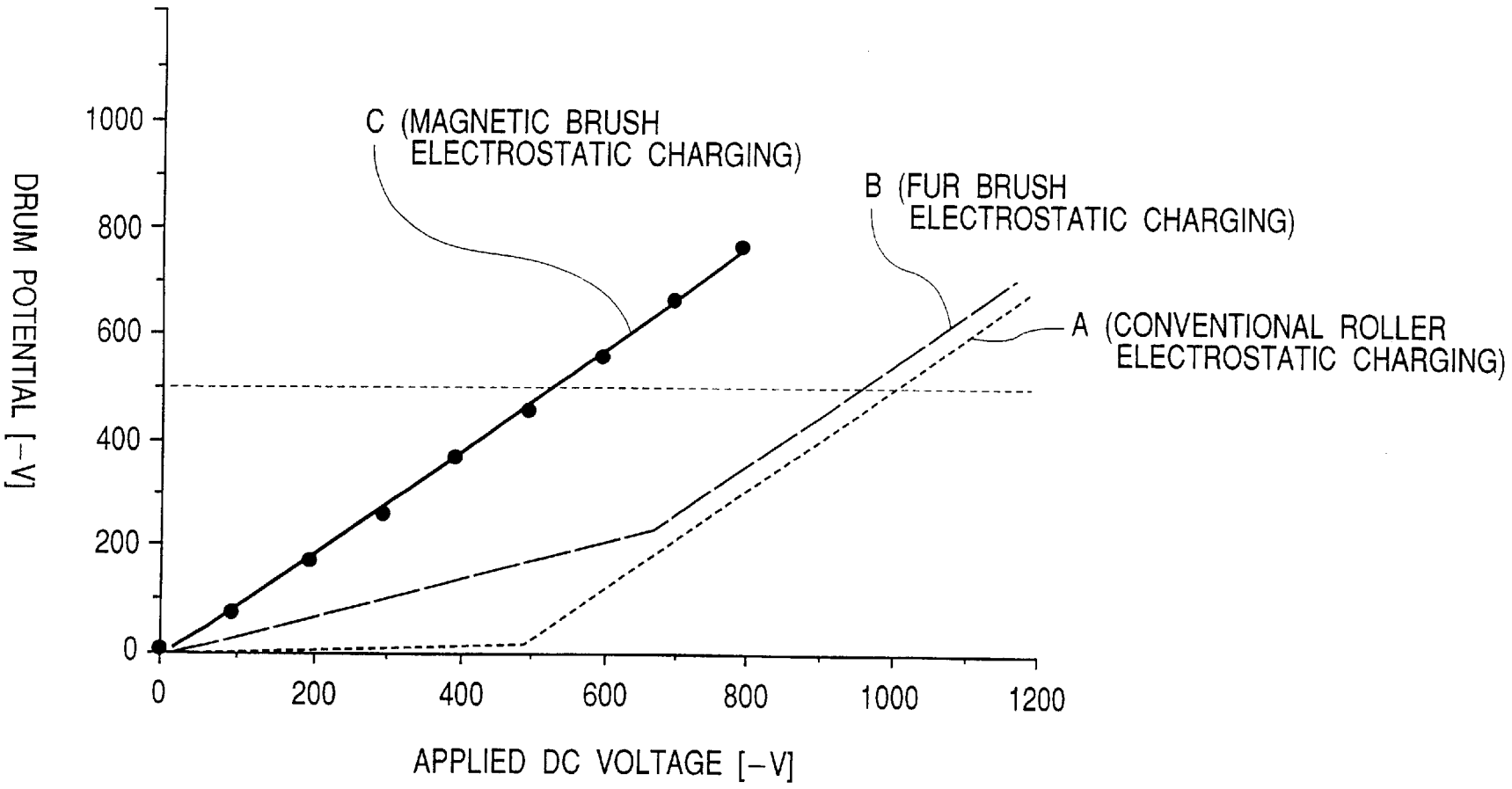
FIG. 11 is a conceptual drawing for an electrification efficiency.

The sequence of the DC bias potential for the electrical conductive member 6 is shown in FIG. 10.

At the image printing time, similar to the embodiment 5, a rectangular wave having a peak to peak voltage of 1600 V, a frequency of 500 Hz and a DC composition of −800 V is applied and, at the nonprinting time, a rectangular wave having a peak to peak voltage of 1600 V, a frequency of 500 Hz and a DC composition of −900 V is applied.

As shown in FIG. 10, at the image printing time, the DC composition is −800, that is, (b−f)e is 0.24[−V/μm] and, at the nonimage printing time, the DC composition is −900 V, that is, (b−f)/e is 0.44[−V/μm].

In this embodiment, during the image printing time, similar to the embodiment 5, the excessively supplied electrification accelerating particles m are allowed to stay M in the proximity alienating portion e between the electrical conductive member 6 and the electrifying roller 2 as shown in FIG. 8 so that the electrification accelerating particles m are prevented to be supplied excessively on the surface of the photosensitive member 1.

At the nonprinting time, since (b−f)/e becomes larger than 0.3[−V/μm], the stay M of the electrification accelerating particles m as shown in FIG. 8 is not caused, but the accumulated electrification accelerating particles m are discharged and the excessive amount of the electrification accelerating particles can be recovered inside the developing apparatus 3 through the surface of the photosensitive member 1.

In this embodiment, since the electrification accelerating particles m stay M in front of the proximity alienating portion e between the electrical conductive member 6 and the electrifying roller 2 and have a high number of charge quantities, the re-recovery thereof toward the developing apparatus 3 is possible in a highly efficient manner.

For this reason, the continuous adherence of the electrification accelerating particles m on the surface of the photosensitive member 1 is prevented and an excellent print image can be obtained without affecting the print image harmfully.

<OTHERS>

1) The electrifying roller 2 as a contact electrifying member is not limited to the configuration of the electrostatic roller of the embodiments. It can be replaced with a rotating belt member. A material or a form such as a felt, a cloth and the like can be used. Moreover, by laminating them, it is possible to obtain more proper elasticity and conductivity.

2) The injection charge mechanism in the electrostatic charging is such that a contacting ability to the electrified member of the contact electrifying member has a noticeable effect on the electrification property. Hence, the contact electrifying member is not only more precisely configured, but also configured to have a number of peripheral speed differences with the electrified member and to contact the electrified member at higher frequencies.

Moreover, the charge injection layer is provided on the surface of the electrified member, thereby controlling the resistance of the electrified member to make the injection charging mechanism in the contact electrification dominantly workable.

The charge injection layer is formed in a film by a photo-curing method after coating $SnO_2$ ultra-micro particle (a diameter of about 0.03μm) as an electrical conductive particle (electrical conductive filler), lubricating agents such as 4 fluoride ethylene resin (trade name: TEFULON), polymerization initiator and the like which are mixed and dispersed in photo-curing type acryl resin as a binder.

The important point as the charge injection layer is found in the resistance of surface layer. In the electrostatic charging method by the direct injection of a charge, by reducing the resistance at the side of the electrified member, the giving and receiving of the charge is made more efficiently. On the other hand, when it is used as a photosensitive member, since it is necessary to hold an electrostatic latent image for a certain time, the volume resistivity of the charge injection layer is acceptable to be kept in a range of $1\times10^{9}$–$1\times10^{14}$ (Ω.cm).

Moreover, even in the case where the charge injection layer is not used, the same effect can be obtained when, for example, the charge conveying layer is within the range of the above described volume resistivity.

Further, even when an amorphous silicon photosensitive member having the volume resistivity of the surface layer of $10^{13}$ Ω.cm is used, the same effect is obtained.

3) When an AC voltage (alternating voltage) composition is applied to the contact electrifying member, the developing apparatus and the like, a sine wave, a rectangular wave, a chopping wave and the like as the AC voltage waveform can be used as occasion demands. Moreover, the rectangular wave formed by periodically turning a direct current power source on and off may be used. In this manner, a bias where the value of the voltage is periodically changed as a waveform of the alternating voltage can be used.

4) An image exposing means for forming an electrostatic latent image is not limited to a laser scanning exposing means for forming a digital-like latent image such as the example of the embodiment, but other light-emitting element such as an ordinary analogue-like image exposure, LED and the like may be acceptable. Whatever it may be, it is acceptable if it can form an latent image corresponding to the image information such as the combination of the light-emitting elements such as fluorescent lamp and the like and a liquid-crystal shutter and the like.

An image bearing member 1 may be an electrifying recording dielectric substance. In this case, the surface of the dielectric substance is uniformly primarily charged with a predetermined polarity and potential and, after this, selectively rejected from the charge by a charge rejecting means such as a charge rejecting needle head, an electron gun and the like so that the object electrostatic latent image is written and formed.

5) The developing means 3 were described in the example of the embodiment with reference to the reversal developing which is caused by the non-magnetic one composition insulating developers. Needles to mention, however, the developing method and configuration thereof should not be limited to those described in the embodiments. Even normal developing means may be acceptable.

6) The image forming apparatus of the present invention may be provided with a cleaner for removing the transfer residual developers and papers from the surface of the image bearing member after the transfer.

7) The recorded member for receiving the transfer of the developer image from the image bearing member 1 may be an intermediate transferring material such as a transfer drum and the like.

8) The electrical conductive member 6 can be also replaced with a nonrotary fixed member.

As described above, according to the present invention, in the contact electrifying method using the electrification accelerating particles, the electrical conductive member is placed noncontact-wise opposite to the image bearing member between the transfer process and the electrification process and, by applying a voltage including the alternating current to the electrical conductive member or by placing the electrical conductive member noncontact-wise in close proximity to the rotating contact electrifying member so as to apply the alternating current, the transfer residual developers are allowed to have a proper charge, thereby preventing the excessive amount of the electrification accelerating particles from adhering on the surface of the image bearing member to affect the print image with the result that an excellent electrification property and print image can be obtained.

While the embodiments of the present invention have been described as above, it is evident that the present invention is not limited to these embodiments but all modifications and variations will be possible in the light of the technological concept.

What is claimed is:

1. An image forming apparatus comprising:

an image bearing member for bearing an electrostatic image;

a developing means for developing the electrostatic image on said image bearing member with toners charged with a predetermined polarity;

a transfer means for transferring a toner image on said image bearing member to a transferring material;

an electrifying means for inject-charging the image bearing member having transfer residual toners;

an electrical conductive member provided and spaced apart from said image bearing member in a moving direction of the image bearing member downstream further than said transfer means and upstream further than said electrifying means; and an electrical field forming means for forming an alternative electrical field between said electrical conductive member and said image bearing member.

2. The image forming apparatus according to claim 1, wherein said electrical conductive member recovers the toners charged in reverse to the predetermined polarity.

3. The image forming apparatus according to claim 2, wherein the toners recovered on said electrical conductive member are charged with the predetermined polarity by rubbing against said electrical conductive member.

4. The image forming apparatus according to claim 3, wherein the toners charged with the predetermined polarity on said electrical conductive member are restored to said image bearing member.

5. The image forming apparatus according to claim 1, wherein said electrifying means have an electrifying roll for contacting said image bearing member at a contact portion and electrical conductive particles are interposed in said contact portion.

6. The image forming apparatus according to claim 5, wherein said developing means have the electrical conductive particles charged in reverse to the predetermined polarity and supply the electrical conductive particles to a non-image portion of said image bearing member.

7. The image forming apparatus according to claim 1, wherein said electrical field forming means apply a voltage superimposed with a direct current and an alternating current to the electrical conductive member and, when a peak to peak voltage of the alternating current applied to the electrical conductive member is taken as a[V], a direct current bias potential applied to the electrical conductive member is taken as b[−V], a distance between the electrical conductive member and a photosensitive member is taken as c[$\mu$m], and an electrification potential of said image bearing member is taken as d[−V], a/c is equal to or more than 1[V/$\mu$m] and (b−d)/c is equal to or more than 0.2[−V/$\mu$m].

8. The image forming apparatus according to claim 1, wherein said electrical field forming means applies a voltage formed by superimposing a direct current and an alternating current to said electrical conductive member and, when a peak to peak voltage of the alternating current applied to the electrical conductive member is taken as a[V], a direct current bias potential applied to the electrical conductive member is taken as b[−V], a distance between the electrical conductive member and the image bearing member is taken as c[$\mu$m], and an electrification potential of said image bearing member is taken as d[−V], a/c is equal to or more than 1[V/μm], and (b−d)/c is equal to or more than −0.3[−V/μm] and equal to or less than 0.3[−V/μm].

9. The image forming apparatus according to claim 1, wherein said electrical field forming means can change the electrical field to be formed.

10. The image forming apparatus according to claim 9, wherein said electrical field forming means applies voltage formed by superimposing a direct current and an alternating current to the electrical conductive member and, when a current bias potential applied to the electrical conductive member is taken as b[−V], a distance between the electrical conductive member and the image bearing member is taken as c[μm] and an electrification potential of said image bearing member is taken as d[−V], (b−d)/c(−V/μm) can be changed to one of being from 0.2 to 0.3 and also equal to or more than 0.3.

11. The image forming apparatus according to claim 1, wherein said electrical conductive member comprises a roll.

12. An image forming apparatus comprising:

an image bearing member for bearing an electrostatic image;

a developing means for developing the electrostatic image on said image bearing member with toners charged with a predetermined polarity;

a transfer means for transferring the toner image on said image bearing member to the transferring material;

an electrifying member for contacting the image bearing member having transfer residual toners and for inject-charging said image bearing member;

an electrical conductive member provided and spaced apart from said electrifying member; and an electrical field forming means for forming an alternating electrical field between said electrical conductive member and said electrifying member, wherein said electrical conductive member recovers the toners charged in reverse to the predetermined polarity.

13. The image forming apparatus according to claim 12, wherein the toners recovered on said electrical conductive member are charged with the predetermined polarity by rubbing against said electrical conductive member.

14. The image forming apparatus according to claim 13, wherein the toners on said electrical conductive member charged with the predetermined polarity are restored to said electrifying member.

15. The image forming apparatus according to claim 12, wherein said electrifying member is like a roll and electrical conductive particles are interposed at a contact portion between the electrifying member and said image bearing member.

16. The image forming apparatus according to claim 15, wherein said developing means have the electrical conductive particles charged in reverse to the predetermined polarity and supply the electrical conductive particles to a non-image portion of said image bearing member.

17. The image forming apparatus according to claim 12, wherein said electrical field forming means applies a voltage formed by superimposing an alternating current and a direct current to said electrical conductive member and, when a peak to peak voltage of the alternating current applied to the electrical conductive member is taken as a[V], an direct current bias potential applied to the electrical conductive member is taken as b[−V], a distance between the electrical conductive member and the contact electrifying member is taken as e[μm], and a contact electrifying member applied potential is taken as f[−V], a/e is equal to or more than 1 V/μm and (b−f)/e is equal to or more than 0.2[−V/μm].

18. The image forming apparatus according to claim 12, wherein said electrical field forming means applies a voltage formed by superimposing an alternating current and direct current to said electrical conductive member and, when a peak to peak voltage of the alternating current applied to the electrical conductive member is taken as a[V], a direct current bias potential applied to the electrical conductive member is taken as b[−V], a distance between the electrical conductive member and the contact electrifying member is taken as e[μm],and a contact electrifying member applied potential is taken as f[−V], a/e is equal to or more than 1 V/μm and (b−f)/e is equal to or more than −0.3[−V/μm] and equal to or less than 0.3[−V/μm].

19. The image forming apparatus according to claim 12, wherein said electrical field forming means can change the electrical field to be formed.

20. The image forming apparatus according to claim 19, wherein said electrical field forming means applies a voltage superimposing an alternating current and a direct current to the electrical conductive member and, when a peak to peak voltage of the alternating current applied to the electrical conductive member is taken as a[V], a direct current bias potential applied to the electrical conductive member is taken as b[−V], a distance between the electrical conductive member and the contact electrifying member is taken as e[μm], and a contact electrifying member applied potential is taken as f[−V], (b−c)/c[−V/μm] can be changed to one of from 0.2 to 0.3 and equal to or more than 0.3.

21. The image forming apparatus according to claim 12, wherein said electrical conductive member comprises a roll.

* * * * *

UNITED STATES PATENT AND TRADEMARK OFFICE

CERTIFICATE OF CORRECTION

PATENT NO. : 6,442,362 B2
DATED : August 27, 2002
INVENTOR(S) : Jun Hirabayashi et al.

It is certified that error appears in the above-identified patent and that said Letters Patent is hereby corrected as shown below:

Title page,
Item [56], References Cited, "6,173,144 B1 1/2001 Hrabayashi et al." should read -- 6,173,144 B1 1/2001 Hirabayashi et al. --.
Item [57], ABSTRACT,
Line 10, "provided" should read -- is provided --; and
Lines 14 through 16, "for forming" should read -- forms --.

Column 1,
Line 42, "needs" should read -- need --; and
Line 57, "can not" should read -- cannot --.

Column 2,
Line 18, "toners;" should read -- toners; --.

Column 3,
Line 4, "a" should be deleted.

Column 4,
Line 37, "rotaty" should read -- rotary --.

Column 6,
Line 6, "tip" should read -- nip --.

Column 8,
Line 57, "cross sectional" should read -- cross-sectional --.

Column 9,
Line 41, "contract" should read -- contrast --; and
Line 55, "sold" should read -- solid --.

Column 10,
Line 27, "contract" should read -- contrast --.

UNITED STATES PATENT AND TRADEMARK OFFICE

CERTIFICATE OF CORRECTION

PATENT NO. : 6,442,362 B2
DATED : August 27, 2002
INVENTOR(S) : Jun Hirabayashi et al.

It is certified that error appears in the above-identified patent and that said Letters Patent is hereby corrected as shown below:

Column 11,
Line 62, “contact wise” should read -- contact-wise --.

Column 12,
Line 8, “flied” should read -- flown --.

Column 14,
Line 8, “to” should read -- with --; and
Line 23, “a” (first occurrence) should read -- an --.

Column 15,
Line 8, “cleaner-less” should read -- cleanerless --.

Column 17,
Line 5, “pint” should read -- print --; and
Line 38, “based” should read -- based on --.

Column 18,
Line 35, “small” should read -- smaller --;
Line 45, “addition” should read -- addition to --; and “above described” should read -- above-described --;
Line 52, “flied” should read -- flown --; and
Line 63, “front” should read -- front of --.

Column 19,
Line 6, “buy” should read -- by --.

Column 21,
Line 16, “an” should read -- a --; and
Line 32, “Needles” should read -- Needless --.

UNITED STATES PATENT AND TRADEMARK OFFICE

CERTIFICATE OF CORRECTION

PATENT NO. : 6,442,362 B2
DATED : August 27, 2002
INVENTOR(S) : Jun Hirabayashi et al.

It is certified that error appears in the above-identified patent and that said Letters Patent is hereby corrected as shown below:

Column 24,
Line 10, “an” should read -- a --; and
Line 29, “e[$\mu$m],and” should read -- e[$\mu$m], and--.

Signed and Sealed this

Twenty-eighth Day of January, 2003

JAMES E. ROGAN
*Director of the United States Patent and Trademark Office*